US007866308B2

(12) United States Patent
Jones et al.

(10) Patent No.: US 7,866,308 B2
(45) Date of Patent: Jan. 11, 2011

(54) PNEUMATIC PAINTBALL GUN WITH VOLUME RESTRICTOR

(75) Inventors: Danial S. Jones, Ligonier, PA (US); William M. Gardner, Jr., Ligonier, PA (US); Hans Semelsberger, Loyalhanna, PA (US)

(73) Assignee: Smart Parts, Inc., Loyalhanna, PA (US)

( * ) Notice: Subject to any disclaimer, the term of this patent is extended or adjusted under 35 U.S.C. 154(b) by 0 days.

(21) Appl. No.: 12/619,527

(22) Filed: Nov. 16, 2009

(65) Prior Publication Data

US 2010/0282232 A1 Nov. 11, 2010

Related U.S. Application Data

(63) Continuation of application No. 11/545,089, filed on Oct. 6, 2006, now abandoned, which is a continuation-in-part of application No. 10/869,829, filed on Jun. 15, 2004, now Pat. No. 7,617,820, and a continuation-in-part of application No. 11/056,938, filed on Feb. 11, 2005, now Pat. No. 7,556,032, and a continuation-in-part of application No. 11/376,690, filed on Mar. 14, 2006, now Pat. No. 7,617,819, which is a continuation of application No. 10/773,537, filed on Feb. 5, 2004, now Pat. No. 7,044,119, which is a continuation of application No. 10/695,049, filed on Oct. 27, 2003, now Pat. No. 7,185,646.

(51) Int. Cl.
*F41B 11/00* (2006.01)

(52) U.S. Cl. ..... 124/71; 124/56

(58) Field of Classification Search ..... 124/71–77, 124/56

See application file for complete search history.

(56) References Cited

U.S. PATENT DOCUMENTS

| | | | | | |
|---|---|---|---|---|---|
| 2,116,860 | A | * | 5/1938 | Blaylock et al. | 124/32 |
| 2,304,320 | A | * | 12/1942 | Tratsch | 124/77 |
| 2,554,116 | A | * | 5/1951 | Monner | 124/74 |
| 2,568,432 | A | * | 9/1951 | Cook | 124/65 |
| 2,594,240 | A | * | 4/1952 | Wells | 124/76 |
| 2,634,717 | A | * | 4/1953 | Junkin | 124/75 |

(Continued)

*Primary Examiner*—Michael Carone
*Assistant Examiner*—Jonathan C Weber
(74) *Attorney, Agent, or Firm*—Simple IP Law, P.C.; Craig R. Rogers

(57) ABSTRACT

A volume restrictor can be provided for a pneumatic paintball gun to reduce the volume of compressed gas available within a compressed gas storage area for a firing operation of the paintball gun. In one embodiment, the volume restrictor includes a body having a forward end and a rearward end. A forward sealing member can be arranged on the forward end to seal around a bolt of the paintball gun. A rearward sealing member can be arranged on the rearward end of the body to seal against a rearward endwall of the compressed gas storage area. By placing the volume restrictor within the compressed gas storage area of the paintball gun, the volume of compressed gas available for a firing operation is reduced, thereby requiring an increased operating pressure to achieve the same paintball velocity. The increased chamber pressure can result in a shorter recharge time and less velocity drop off in successive shots. A set of volume restrictors can be provided to permit a user to selectively adjust the available volume of compressed gas in the compressed gas storage chamber. Other configurations of volume restrictors are also contemplated within this invention, for example, such as non-sealing volume restricting rings having various wall thicknesses.

25 Claims, 21 Drawing Sheets

U.S. PATENT DOCUMENTS 2,834,332 A * 5/1958 Guthrie ..... 124/65
2,845,055 A * 7/1958 Collins et al. ..... 124/77
3,089,476 A * 5/1963 Wolverton ..... 124/77
3,192,915 A * 7/1965 Norris et al. ..... 124/77
3,662,729 A * 5/1972 Henderson ..... 124/73
3,695,246 A * 10/1972 Filippi et al. ..... 124/72
3,855,988 A * 12/1974 Sweeton ..... 124/56
3,915,143 A * 10/1975 Waller ..... 124/77
3,921,980 A * 11/1975 Artzer ..... 124/77
4,009,536 A * 3/1977 Wolff ..... 42/84
4,094,294 A * 6/1978 Speer ..... 124/56
4,269,163 A * 5/1981 Feith ..... 124/77
4,362,145 A * 12/1982 Stelcher ..... 124/32
4,730,407 A * 3/1988 DeCarlo ..... 42/84
4,770,153 A * 9/1988 Edelman ..... 124/72
4,819,609 A * 4/1989 Tippmann ..... 124/72
4,899,717 A * 2/1990 Rutten et al. ..... 124/67
4,936,282 A * 6/1990 Dobbins et al. ..... 124/74
5,063,905 A * 11/1991 Farrell ..... 124/72
5,083,392 A * 1/1992 Bookstaber ..... 42/84
5,228,427 A * 7/1993 Gardner, Jr. ..... 124/71
5,261,384 A * 11/1993 Hu ..... 124/66
5,280,778 A * 1/1994 Kotsiopoulos ..... 124/73
5,285,765 A * 2/1994 Lee ..... 124/50
5,333,594 A * 8/1994 Robinson ..... 124/73
5,337,726 A * 8/1994 Wood ..... 124/61
5,349,938 A * 9/1994 Farrell ..... 124/73
5,383,442 A * 1/1995 Tippmann ..... 124/76
5,413,083 A * 5/1995 Jones ..... 124/32
5,462,042 A * 10/1995 Greenwell ..... 124/76
5,515,838 A * 5/1996 Anderson ..... 124/76
5,613,483 A * 3/1997 Lukas et al. ..... 124/73
5,727,538 A * 3/1998 Ellis ..... 124/77
5,878,736 A * 3/1999 Lotuaco, III ..... 124/71
5,881,707 A * 3/1999 Gardner, Jr. ..... 124/77
5,967,133 A * 10/1999 Gardner, Jr. ..... 124/77
6,003,504 A * 12/1999 Rice et al. ..... 124/73
6,035,843 A * 3/2000 Smith et al. ..... 124/77
6,343,599 B1 * 2/2002 Perrone ..... 124/73
6,349,711 B1 * 2/2002 Perry et al. ..... 124/73
6,474,326 B1 * 11/2002 Smith et al. ..... 124/77
6,516,791 B2 * 2/2003 Perrone ..... 124/77
6,520,172 B2 * 2/2003 Perrone ..... 124/74
6,532,949 B1 * 3/2003 McKendrick ..... 124/77
6,637,421 B2 * 10/2003 Smith et al. ..... 124/77
6,644,295 B2 * 11/2003 Jones ..... 124/77
6,644,296 B2 * 11/2003 Gardner, Jr. ..... 124/77
6,708,685 B2 * 3/2004 Masse ..... 124/75
6,763,822 B1 * 7/2004 Styles ..... 124/77
7,044,119 B2 * 5/2006 Jones ..... 124/74
7,185,646 B2 * 3/2007 Jones ..... 124/74
7,210,473 B2 * 5/2007 Jong ..... 124/73
7,237,545 B2 * 7/2007 Masse ..... 124/75
2002/0096164 A1 * 7/2002 Perrone ..... 124/77
2002/0170551 A1 * 11/2002 Kotsiopoulos et al. ..... 124/54
2002/0170552 A1 * 11/2002 Gardner, Jr. ..... 124/56
2003/0005918 A1 * 1/2003 Jones ..... 124/70
2004/0065310 A1 * 4/2004 Masse ..... 124/75
2004/0216728 A1 * 11/2004 Jong ..... 124/74
2004/0237954 A1 * 12/2004 Styles et al. ..... 124/77
2005/0115550 A1 * 6/2005 Jones ..... 124/65
2005/0115552 A1 * 6/2005 Dobbins ..... 124/73
2005/0115554 A1 * 6/2005 Jones ..... 124/74
2005/0121014 A1 * 6/2005 Monks et al. ..... 124/32
2005/0145235 A1 * 7/2005 Jong ..... 124/73
2006/0011186 A1 * 1/2006 Jones et al. ..... 124/73
2006/0011188 A1 * 1/2006 Jones ..... 124/77
2006/0032487 A1 * 2/2006 Tippmann et al. ..... 124/74
2006/0090739 A1 * 5/2006 Jones ..... 124/73
2006/0107939 A1 * 5/2006 Dobbins ..... 124/73
2006/0157043 A1 * 7/2006 Jones ..... 124/74
2006/0207586 A1 * 9/2006 Jones ..... 124/74
2007/0017497 A1 * 1/2007 Masse ..... 124/73
2007/0039601 A1 * 2/2007 Jong ..... 124/73
2007/0068502 A1 * 3/2007 Jones et al. ..... 124/77
2007/0151549 A1 * 7/2007 Wood ..... 124/73
2007/0181115 A1 * 8/2007 Jong ..... 124/73
2009/0032003 A1 * 2/2009 Masse ..... 124/73

* cited by examiner

PNEUMATIC PAINTBALL GUN WITH VOLUME RESTRICTOR

This application is a continuation of U.S. patent application No. 11/545,089, filed Oct. 6, 2006, which is a continuation-in-part of U.S. patent application Ser. No. 10/869,829 (now U.S. Pat. No. 7,617,820), filed Jun. 15, 2004, and U.S. patent application Ser. No. 11/056,938, filed Feb. 11, 2005 (now U.S. Pat. No. 7,556,032), the contents of each of which are incorporated herein by reference in their entireties. This application is also a continuation-in-part of U.S. patent application Ser. No. 11/376,690, filed Mar. 14, 2006, which is a continuation of U.S. patent application Ser. No. 10/773,537 (now U.S. Pat. No. 7,044,119), filed Feb. 5, 2004, which is a continuation of U.S. patent application Ser. No. 10/695,049 (now U.S. Pat. No. 7,185,646), filed Oct. 27, 2003; the contents of each of which are incorporated herein by reference, in their entirety.

BACKGROUND OF THE INVENTION

1. Field of the Invention

This invention relates generally to pneumatic paintball guns ("markers") and their operating components. More particularly, this invention relates to a pneumatic paintball gun and the pneumatic components used to load a paintball into and fire it from the paintball gun.

2. Related Art

In the sport of paintball, it is generally desirable to have a marker that is as small and light as possible. Smaller and lighter markers increase a players' mobility. Players benefit from increased mobility by being able to move more quickly from bunker to bunker, making it easier to avoid being hit. Further, in the sport of paintball, the marker is treated as an extension of the body such that a hit to the marker counts as a hit to the player. It is desirable, therefore, to have a paintball gun with as small a profile as possible while substantially maintaining or improving performance characteristics of the marker, such as firing rate, accuracy, and gas efficiency. The size of the paintball gun is generally related to the size and number of operating components that must be housed within the paintball gun body.

It is further desirable to have a paintball marker that includes fewer, less complex, and less expensive, operating components and that can be more easily manufactured. The cost savings can then be passed on to the consumer. The industry is in need of a small, light, and inexpensive paintball marker that provides reliable and efficient operation.

SUMMARY OF THE INVENTION

In one embodiment of the present invention, a pneumatic paintball gun can include a body and a grip frame. The body and the grip frame can be formed separately or integrally, and are preferably formed from a molded plastic, rubber, or other rugged but relatively inexpensive material. The body preferably includes a chamber configured to receive a pneumatic assembly. The pneumatic assembly preferably provides several of the operating components of the paintball gun including a bolt, a compressed gas storage area, and a firing mechanism. A pneumatic assembly housing can be formed of metal, plastic, or a combination of materials and, in addition to housing the pneumatic components, can be configured to receive a barrel and a feed tube. A pneumatic regulator can also be provided and can, for example, be a vertical, in-line regulator or a bottom-mount regulator.

The bolt preferably includes a forward and a rearward piston surface area. A quantity of compressed gas is preferably selectively supplied and vented from a forward piston surface area through a mechanical or electro-pneumatic valving mechanism. The firing mechanism preferably consists of a sealing member arranged in selective communication with an outer surface of the bolt. One or more firing ports are preferably arranged in the bolt to communicate compressed gas through the bolt to launch a paintball. Compressed gas from the regulator can be supplied to the compressed gas storage area through a supply port. The flow of compressed gas into the compressed gas storage area can be restricted or prevented during a firing operation to increase gas efficiency of the paintball gun.

In operation, compressed gas is preferably supplied to the paintball gun from a compressed gas container through a pressure regulator. The compressed gas is preferably directed from the pressure regulator to the valving mechanism and to a supply port for feeding the compressed gas storage area. Compressed gas supplied to the valving mechanism is preferably transferred through the valving mechanism to the forward surface area of the bolt piston when the valving mechanism is in a neutral (non-actuated) position. This compressed gas acts on the forward bolt piston surface area to force the bolt into a rearward position, While the bolt is in a rearward position, a paintball is allowed to load into a breech of the paintball gun from the feed tube. In addition, while the bolt is rearward, the gas supply port is preferably allowed to rapidly transmit compressed gas into the compressed gas storage area.

A trigger mechanism is preferably configured to operate the valving mechanism. When the trigger is depressed, the valving mechanism is preferably actuated to vent compressed gas away from the forward piston surface area of the bolt. Compressed gas is preferably applied to a rearward surface area of the bolt piston. The rearward surface area of the bolt piston can be arranged, for example, in the compressed gas storage area or at a rearward end of the bolt. The compressed gas applied to the rearward surface area of the bolt piston can therefore be supplied from the compressed gas storage area or from a separate supply port. When the compressed gas is vented from the forward bolt piston surface area, the pressure applied to the rearward bolt piston surface area preferably causes the bolt to move to a forward position.

When the bolt transitions to its forward position, a sealing member of the firing mechanism preferably disengages from the bolt surface area, permitting compressed gas from the compressed gas storage area to enter the bolt firing ports and launch a paintball from the marker. In addition, with the bolt in the firing position, the flow of compressed gas into the compressed gas storage area can be restricted. This can be accomplished, for instance, by configuring a rearward portion of the bolt to reduce the area through which compressed gas travels from the supply port to the compressed gas storage area. Alternatively, the supply of compressed gas to the compressed gas storage chamber can be cut off completely to prevent compressed gas from entering the storage chamber during the firing operation. This can be accomplished, for instance, by closing off the gas supply port using sealing members on a rearward end of the bolt, using sealing members on a separate, independent piston, by pinching a gas supply tube, or using a separate valving mechanism.

The valving mechanism can be a solenoid valve (such as a three-way solenoid valve), a mechanical valve, or other valving mechanism. In the case of a solenoid valve, an electronic circuit is preferably provided to control the operation of the solenoid valve based on actuation of a trigger mechanism. A switch, such as a microswitch or other switching device, is preferably arranged in communication with the trigger to send an actuation signal to the electronic circuit in response to a pull of the trigger. A power source is also preferably provided to supply power to the electronic circuit and solenoid valve. The valving mechanism preferably vents compressed gas away from a forward bolt piston surface area in response to a firing signal from the circuit board. In the case of a mechanical valve, the mechanical valve preferably communicates with the trigger to vent the compressed gas away from the forward bolt piston surface area in response to a trigger pull.

In one embodiment, the bolt is preferably a free-floating bolt with balanced pressure applied to opposite ends of the bolt piston rod. This can be accomplished, for instance, by providing a vent channel from a rearward end of the bolt piston rod through to the forward end of the bolt. Alternatively, the chamber in communication with the rearward end of the bolt piston can be vented to atmosphere through a vent port arranged through the gun body.

According to another aspect of this invention, ribs or fins can be provided lengthwise on the bolt piston with firing channels arranged between the ribs to permit compressed gas to be released from the gun when the bolt is transitioned forward, while still maintaining the position of the sealing member in a retaining groove.

According to a further aspect of this invention, an interchangeable shell can form the outer portion of the paintball gun body surrounding the pneumatic components. The interchangeable shell can, for instance, be a plastic, metal, or composite material, but is preferably ABS plastic. A number of interchangeable shells can be provided of different shapes, colors, and body styles to permit a user to customize their gun to a desired appearance.

According to a still further aspect of this invention, an improved apparatus and method for grip mounting a circuit board can be provided. According to this method, one or more slots are preferably arranged in the grip frame to receive the circuit board. Most preferably, one slot is arranged on each side of the grip frame to receive opposing sides of the circuit board. The depth of the slots is preferably selected to arrange the circuit board in the appropriate location when the circuit board is fully inserted into the slots. In this embodiment, no tools or mounting screws are required to secure the circuit board in the paintball gun, thereby reducing the cost of parts and the cost of manufacturing. Manufacturing consistency is also improved. In addition, a solenoid valve can be mounted on the circuit board and arranged in the grip of the paintball gun. The circuit board can further include a trigger-actuated microswitch arranged on the circuit board, preferably on an opposite side of the circuit board from the solenoid valve.

According to another aspect of the present invention, a method of mounting a paintball detection system is provided. According to this method, a mounting slot is preferably arranged in a bottom portion of a pneumatic housing near a breech area of a paintball gun. Holes or slots are preferably arranged through one or more sidewalls of the pneumatic housing at the breech area. A paintball detection system circuit board is preferably mounted within the slot such that a sensor disposed on the circuit board can communicate with an interior of the breech area or with a sensor arranged on an opposite side of the pneumatic housing. The circuit board is preferably shaped to fit within the mounting slot. If a break-beam sensor system is used, holes are preferably arranged in opposing sides of the pneumatic housing in proximity to the location of the break-beam sensors once installed in the pneumatic housing.

A volume restrictor or a set of volume restrictors can be provided to reduce the volume of compressed gas available within a compressed gas storage area for a firing operation of the paintball gun. In one embodiment, a volume restrictor can include a body having a forward end and a rearward end. A forward sealing member can be arranged on the forward end of the body to seal around a bolt of the paintball gun and cooperate with the bolt to provide the firing mechanism of the paintball gun. A rearward sealing member can be arranged on the rearward end of the body to seal against a rearward end-wall of the compressed gas storage area. In this manner, the internal volume of the volume restrictor can provide a new, reduced volume compressed gas storage area. A plurality of differently sized volume restrictors can be provided to permit selection of the proper volume restrictor to achieve the desired volume. By placing a volume restrictor within the compressed gas storage area of the paintball gun, the volume of compressed gas available for a firing operation is reduced, thereby requiring increased operating pressure to achieve the same paintball velocity. The increased chamber pressure can result in a shorter recharge time and less velocity drop off in rapid successive shots.

Other configurations of volume restrictors are also contemplated within this invention, including, for example, volume occupiers that do not seal with the chamber housing, but instead simply occupy a volume of the compressed gas storage area to reduce the volume available for the firing operation. Volume restricting rings of different thicknesses can be used, for example, to reduce the chamber volume by the desired amount. A replacement pneumatic housing that provides a reduced volume compressed gas storage area could also be used.

Various other aspects, embodiments, and configurations of this invention are also possible without departing from the principles disclosed herein. This invention is therefore not limited to any of the particular aspects, embodiments, or configurations described herein.

BRIEF DESCRIPTION OF THE DRAWINGS

The foregoing and additional objects, features, and advantages of the present invention will become more readily apparent from the following detailed description of preferred embodiments, made with reference to the accompanying figures, in which.

DETAILED DESCRIPTION OF PREFERRED EMBODIMENTS

Figure 1:
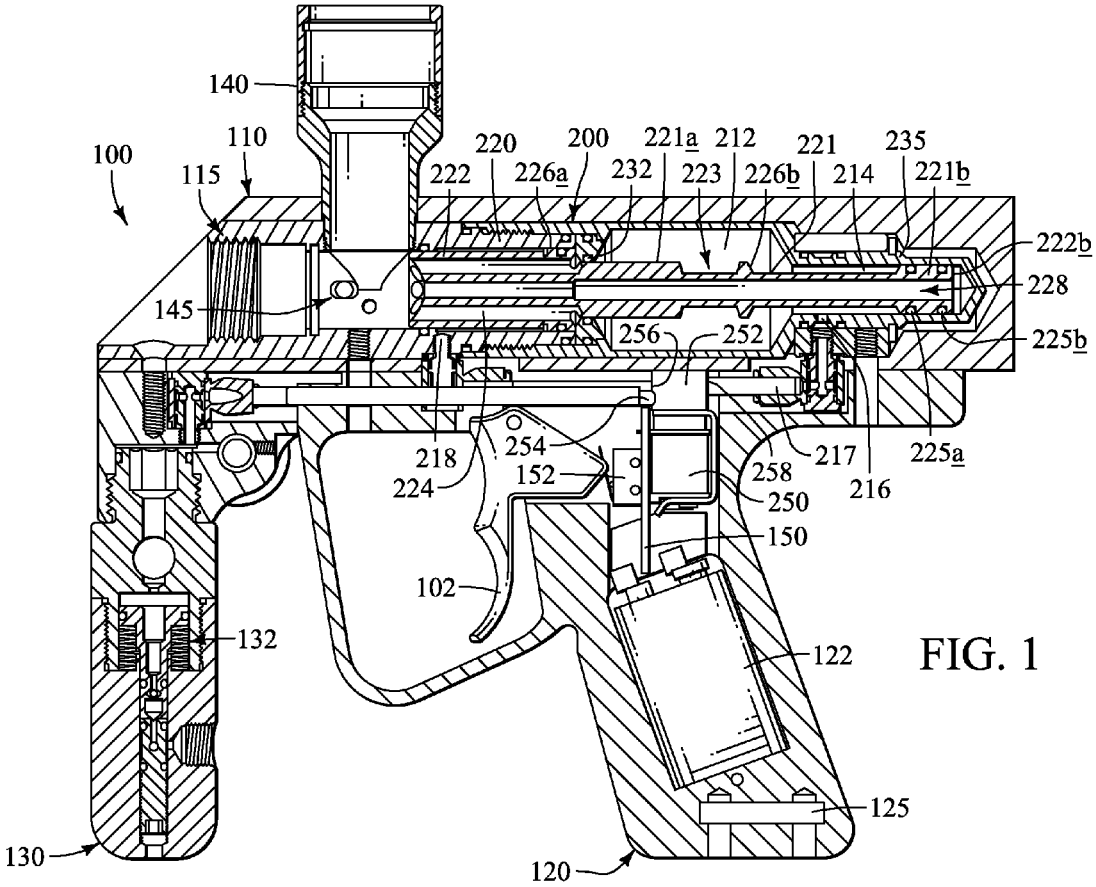
FIG. 1 is a somewhat schematic cross-sectional side view of a paintball gun, shown with a bolt thereof in an rearward (e.g., open) position, according to certain principles of the present invention.

The accompanying drawings show the construction of various preferred embodiments incorporating principles of the present invention. Referring to FIG. 1, a pneumatic paintball gun 100 can be constructed having a body 110 and a grip 120. A foregrip 130 can also be provided. The body 110 and the grip 120 can he formed integrally or separately and can he formed of the same or different materials. The body 110 and the grip 120 are preferably formed of a molded plastic or rubber material, such as ABS plastic, that is durable and shock resistant yet relatively inexpensive.

A pneumatic housing 115 is preferably arranged in the body 110 to house some or all of the pneumatic components, to receive a barrel (not shown), and to receive a feed tube 140. The pneumatic housing 115 is preferably a block or tube formed from a metal such as aluminum, but can be formed of any other metal, plastic, or other material that is sufficiently durable to perform its required functions. The grip 120 and foregrip 130 are preferably secured to the body 110 and the pneumatic housing 115 using screws or other fastening means. A plate 125 is also preferably provided and formed of a rigid material, such as metal, can also be arranged in the grip 120 to permit secure attachment of a tank receptacle (not shown) for connecting to a compressed gas tank.

The foregrip 130 preferably provides a regulator 132 for regulating a supply of compressed gas down to a desired operating pressure. In this embodiment, the desired operating pressure is between about 90 to 350 psi. A battery 122 can be arranged in the grip 120 along with a circuit board 150 and a solenoid valve 250. The solenoid valve 250 of this embodiment is preferably a normally-open, three-way solenoid valve.

A pneumatic assembly 200 is preferably arranged in the body 110 and can be connected to and/or include some or all of the pneumatic housing 115. The pneumatic assembly 200 preferably includes a compressed gas storage area 212, a pneumatic cylinder 220, and a guide chamber 214. A bolt 222 is preferably slidably arranged having a first piston surface area 226*a* located within a pneumatic cylinder 220 in a piston and cylinder assembly. The bolt 222 may further include a guide rod 221 that extends through substantially the entire pneumatic assembly 200.

The guide rod 221 can include a firing valve section 221*a* that communicates with a sealing member 232 to prevent compressed gas from entering the bolt 222 from the compressed gas storage area 212 when the bolt 222 is rearward. The guide rod 221 further preferably includes a rearward section 221*b* that slides back and forth within a guide chamber 214 to provide stability for the bolt and also to restrict or prevent the flow of compressed gas into the compressed gas storage area 212 from a supply port 216 when the bolt 222 is forward. A vent channel 228 may be provided through the bolt 222 and guide rod 221 to prevent back pressure from building up on a rearward end 222*b* of the bolt 222 and provide an essentially free-floating bolt arrangement. This reduces the amount of pressure required to recock the bolt 222. The vent channel also reduces the amount of force applied by a forward end 222*a* of the bolt 222 on a paintball, improves gas efficiency, and eliminates the need for a secondary pressure regulator. Alternatively, a vent channel (not shown) may be provided through the body 110 of the gun 100 to vent the rearward chamber area 214 to atmosphere.

With the bolt 222 in an open position, compressed gas from the regulator 132 is supplied to the compressed gas storage area 212 through the supply port 216. The sealing member 232 preferably communicates between an external surface of the bolt 222 along the firing valve section 221*a* and an inner wall of the pneumatic assembly 200 to prevent compressed gas from entering the bolt 222. The sealing member 232 can, for example, be arranged in a recess of the inner wall (or protrusion from the inner wall) of the pneumatic assembly 200 near a forward end of the compressed gas storage chamber 212.

Alternatively, for example, a bolt port can be arranged through the bolt 222, with an input disposed near a rearward end of the bolt 222, to communicate compressed gas from a rearward end of the compressed gas storage area 212 through the bolt 222 and into communication with a paintball when the bolt transitions to its forward position. In this embodiment, the sealing member 232 could be arranged on the bolt 222 near a rearward end of the compressed gas storage area 212 so as to prevent compressed gas from entering the bolt 222 from the compressed gas storage area 212 when the bolt 222 is open, but to permit compressed gas from the compressed gas storage area 212 to enter the bolt 222 when the bolt is closed.

The solenoid valve 250 preferably selectively supplies compressed gas to and vents compressed gas from the cylinder 220 through the port 218 to move the bolt 222. The solenoid valve 250 preferably comprises a normally-open configuration where compressed gas input into the solenoid valve 250 through an input port 254 is supplied via an output port 256 to the forward piston surface area 226*a* of the bolt 222 to hold the bolt 222 in an open position.

Figure 9:
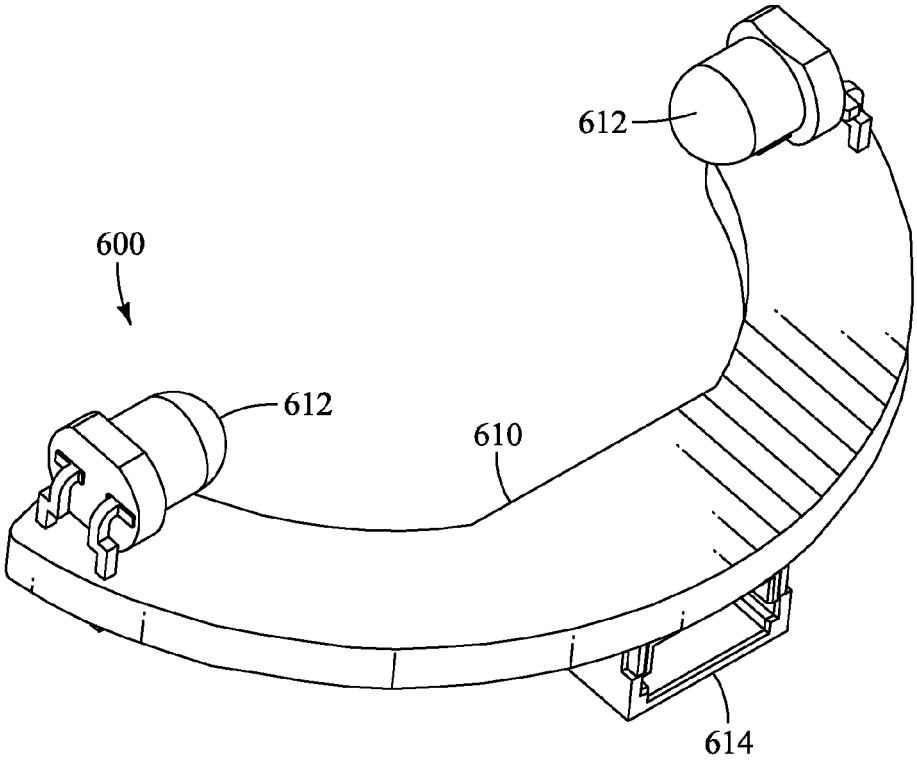
FIG. 9 is a somewhat schematic perspective view of a circuit board and sensor system for the paintball detection system configured for arrangement in the breech section of the paintball gun illustrated in FIGS. 6, 7, and 8.

In response to a trigger pull, a firing signal is preferably sent from the circuit board 150 to the solenoid valve 250 to initiate a firing operation of the paintball gun 100. In response to the firing signal, the solenoid valve 250 preferably vents compressed gas away from the forward piston area 226*a* of the bolt 222. Pressure on an opposing surface area 226*b* of the bolt 222 thereby causes the bolt 222 to transition to a closed position, as shown in FIG. 9. The opposing surface area 226*b* can, for instance, be arranged in the compressed gas storage area 212 as shown in FIGS. 1 and 2.

Alternatively, the opposing surface area 226*b* can be arranged on a rearward end 222*b* of the bolt 222, with compressed gas supplied to the rearward end 222*b* of the bolt 222 through a separate supply channel (not shown). In this alternative embodiment, the vent channel 228 would be omitted to maintain pressure in chamber 214 to function as an air spring. The opposing surface area 226*b* could likewise be positioned anywhere else where it can receive a quantity of compressed gas to force the bolt 222 into a closed position when gas is vented away from the forward surface area 226*a*. The opposing surface area 226*b* preferably has a surface area less than that of the forward surface area 226*a* to prevent the bolt from moving forward until the compressed gas is vented away from the forward surface area 226*a*. Alternatively, a mechanical spring or other biasing member that provides a desired amount of force (preferably less than the amount of force created by the compressed gas on the forward surface area of the bolt 226*a*) could be used to force the bolt 222 into a closed position when compressed gas is vented away from the forward surface area 226*a* of the bolt 222.

Figure 2:
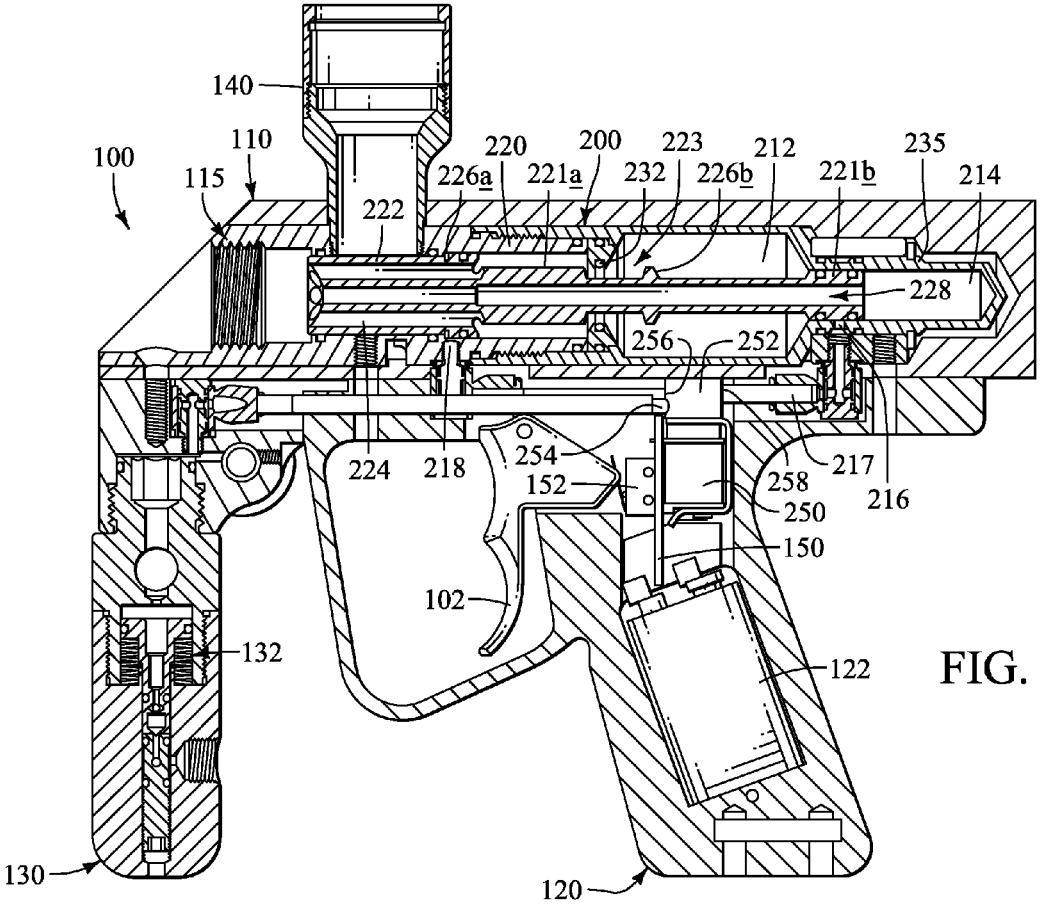
FIG. 2 is a somewhat schematic cross-sectional side view of the paintball gun of FIG. 1, shown with the bolt is disposed in a forward (e.g., closed) position.

Referring now to FIG. 2, with the bolt 222 in the closed position, compressed gas from the compressed gas storage area 212 is permitted to flow into the bolt 222 through channels 223 arranged along an external surface of the bolt 222 and ports 224 arranged to communicate compressed gas from a predetermined location along the exterior of the bolt 222 to a forward end of the bolt 222*a*. While the bolt 222 is in its forward position, entry of compressed gas into the compressed gas storage area 212 from the supply port 216 can be restricted using a glide ring 225*a* arranged on the rearward section of the guide rod 221*b* near a rearward end 222*b* of the bolt 222. A sealing member 225*b* prevents compressed gas from entering the rearward portion of the guide chamber 214 and the vent channel 228. To prevent (rather than restrict) compressed gas from entering into the chamber during the firing operation, the glide ring 225*a* could be replaced by a sealing member (not shown).

Figure 3:
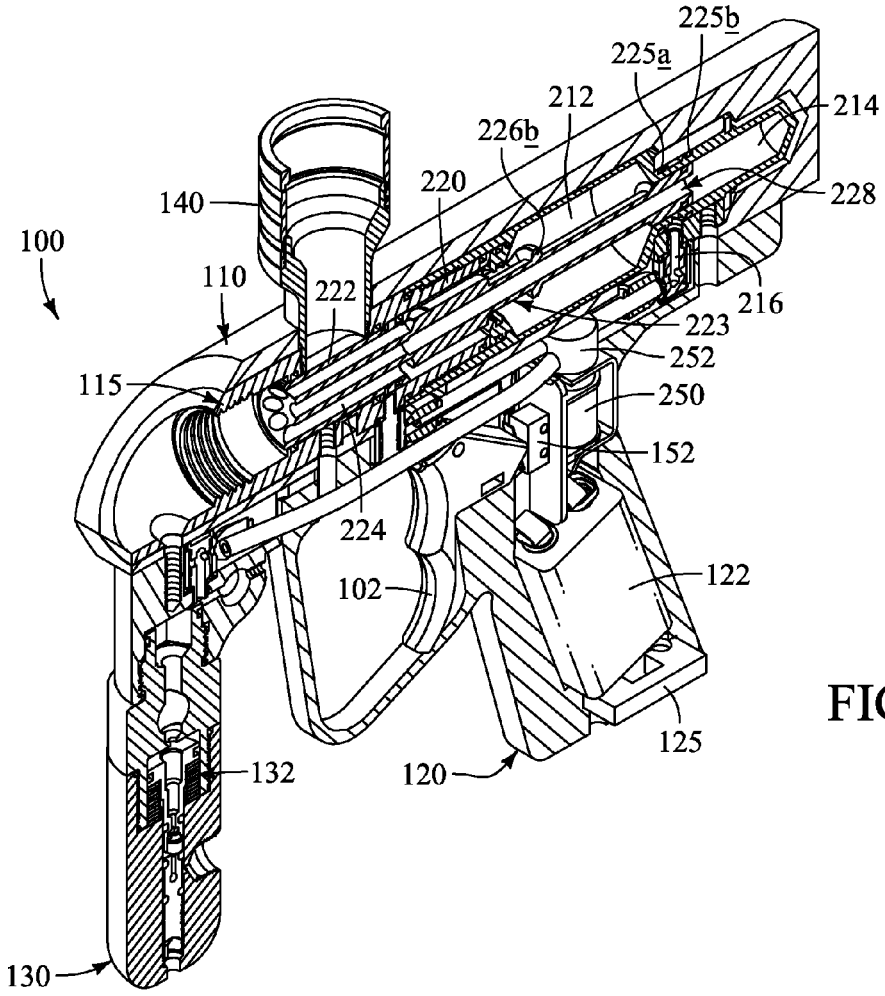
FIG. 3 is a somewhat schematic cross-sectional perspective view of the pneumatic paintball gun illustrated in FIG. 2.

Loading and firing operations of the pneumatic paintball gun 100 will now be described in further detail with reference to FIGS. 1-3. Referring to FIGS. 1, 2, and 3, compressed gas supplied from the regulator 132 to the paintball gun 100 is directed to a manifold 252 arranged in communication with the solenoid valve 250. Compressed gas from the regulator 132 is directed through the manifold to an inlet 254 of the solenoid valve 250. In its normally-open position, the solenoid valve 250 directs compressed gas from the input port 254 to an output port 256 of the manifold 252 to the cylinder 220 and hence the forward bolt piston surface area 226*a*.

Meanwhile, compressed gas from the regulator 132 is also supplied through a second output port 258 of the manifold 252 to a supply port 216, preferably arranged near a rearward end of the compressed gas storage area 212 in a bolt guide cylinder 235. While the bolt 222 is open, compressed gas from the supply port 216 is preferably permitted to rapidly fill the compressed gas storage area 212. A rearward piston surface area 226*b* of the bolt 222 is preferably arranged in or in communication with the compressed gas storage area 212. The forward bolt piston surface area 226*a* is preferably larger than the rearward surface area 226*b*. Thus, in its resting position (e.g., in the absence of a firing signal), the compressed gas supplied to the forward bolt piston surface area 226*a* holds the bolt 222 in an open position against pressure applied to a rearward bolt piston surface area 226*b*. With the bolt 222 in its open (e.g., rearward position), a paintball is permitted to drop from a feed tube 140 into a breech area 145 of the paintball gun 100.

A firing operation of the paintball gun 100 is preferably initiated in response to actuation of a trigger 102. The trigger 102 is preferably configured to initiate a firing operation of the paintball gun 100 through actuation of a microswitch 152 or other switching mechanism when pulled. Actuation of the switching mechanism 152 preferably causes the circuit board 150 to initiate a firing operation by transmitting one or more firing signals to the solenoid valve 250. In the embodiment illustrated in FIGS. 1, 2, and 3, the firing signal is preferably an actuation signal that energizes the solenoid of the solenoid valve 250 for a predetermined duration of time. The trigger 102 could be configured, however to actuate a firing sequence as long as the trigger 102 is pulled, particularly if a mechanical rather than electronic actuation system is utilized.

In response to the firing signal, the solenoid valve 250 preferably vents compressed gas from the forward bolt piston area 226*a*. Pressure applied from the compressed gas storage area 212 to the rearward bolt piston area 226*b* thereby causes the bolt 222 to move to its forward position. As the bolt 222 transitions to its forward position, it forces a paintball that has been loaded in the breech area 145 forward into the rearward end of a barrel (not shown).

In addition, as the bolt 222 approaches its forward position, the channels 223 arranged along the external surface of the bolt 222 slide past the sealing member 232 and allow the compressed gas from the compressed gas storage area 212 to enter into the rearward portion of the cylinder 220. Compressed gas in the rear of the cylinder 220 flows through bolt ports 224 into contact with the paintball in the barrel to cause it to be launched from the gun 100. Also, as the bolt 222 approaches its forward position, a glide ring or sealing member 225*a* slides past the gas supply port 216 to respectively restrict or prevent the flow of compressed gas from the regulator 132 into the compressed gas storage area 212. This can improve the gas efficiency of the paintball gun 100.

Although the embodiment of FIGS. 1, 2, and 3 illustrates the use of an electro-pneumatic valve 250 to control the loading and firing operations of the paintball gun 100, a mechanical valve could be used in place of the solenoid valve 250. Like the solenoid valve 250, the mechanical valve could be configured to supply compressed gas to the forward piston surface area 226*b* through port 218 in a resting position. In response to a pull of the trigger 102, the mechanical valve could be configured to vent the compressed gas away from the forward piston surface area 226*b* to cause the bolt 222 to move forward and perform a firing operation. The trigger 102 could, for example, be directly mechanically coupled to the valve or could communicate with the mechanical valve through one or more intermediate components.

Figure 4:
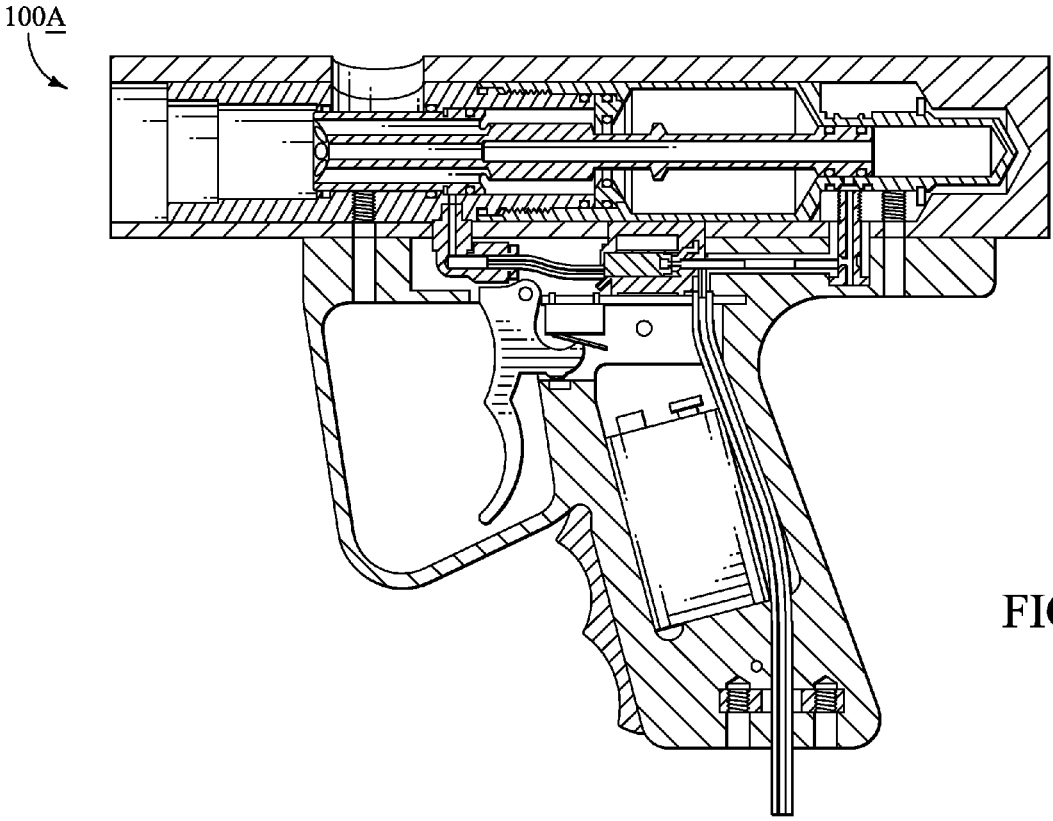
FIG. 4 is a somewhat schematic cross-sectional side view of a paintball gun constructed according to an alternative embodiment of the present invention.
Figure 5:
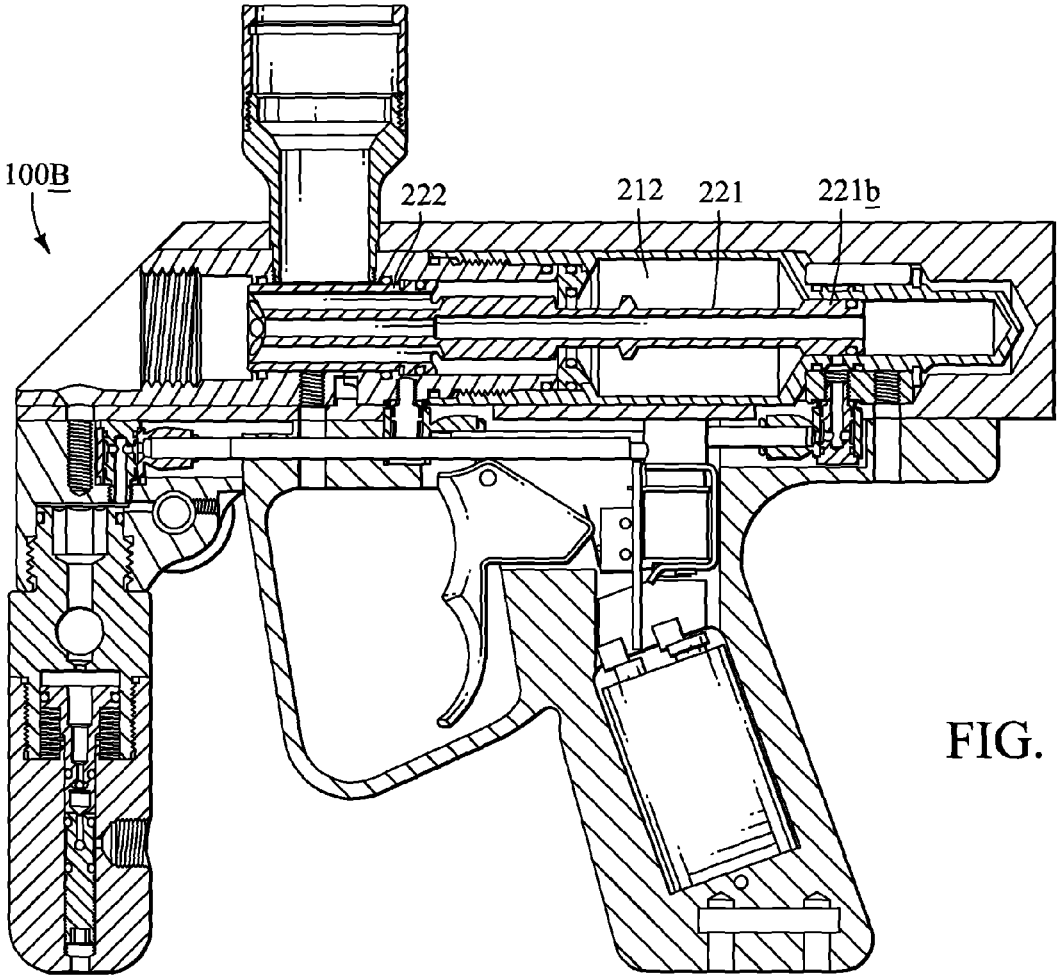
FIG. 5 is a somewhat schematic cross-sectional side view of a paintball gun constructed according to yet another embodiment of the present invention.

Yet other alternative embodiments of the present invention are shown in FIGS. 4 and 5. The paintball gun 100A shown in FIG. 4 is constructed in a manner similar to that shown in FIGS. 1, 2, and 3, except, for instance, the absence of a foregrip 130, compressed gas being supplied to the gun through a tube arranged through the grip 120, and that the solenoid valve 250 is arranged in a different physical relationship with respect to the gun body 110. The primary operating features of this embodiment are essentially the same as that previously described, however, and no additional description of this embodiment will therefore be provided.

The paintball gun 100B depicted in FIG. 5 is also similar to that depicted in FIGS. 1-3, except that the rearward end 221*b* of the guide rod 221 does not contain a glide ring or a sealing ring where the glide ring 225*a* is arranged in the earlier-described embodiment. As with the glide ring, compressed gas is permitted to enter the compressed gas storage chamber 212 even when the bolt is in its forward position. The tolerance between the guide rod 221 and the guide chamber 214 can be configured, however, such that the rate of flow of compressed gas into the compressed gas storage chamber 212 can be restricted while the bolt 222 is arranged in its forward position. This can result in improved gas efficiency and make the bolt 222 easier to move to its retracted position.

Various other alternative embodiments are also contemplated. In particular, rather than use a portion of the bolt 222 to restrict or prevent compressed gas from entering the compressed gas storage area 212, other mechanisms could be used to provide this function. For example, a separate piston could be arranged to slide back and forth in the rearward bolt guide area to block or restrict the supply of compressed gas from the supply port 214 into the compressed gas storage area 212. In yet another potential embodiment, a mechanical, pneumatic, or electro-pneumatic pinching member could be provided to pinch a gas supply tube (e.g., tube 217) to prevent or restrict the flow of compressed gas into the compressed gas storage area 212 while the bolt 222 is in the forward position.

Figure 6:
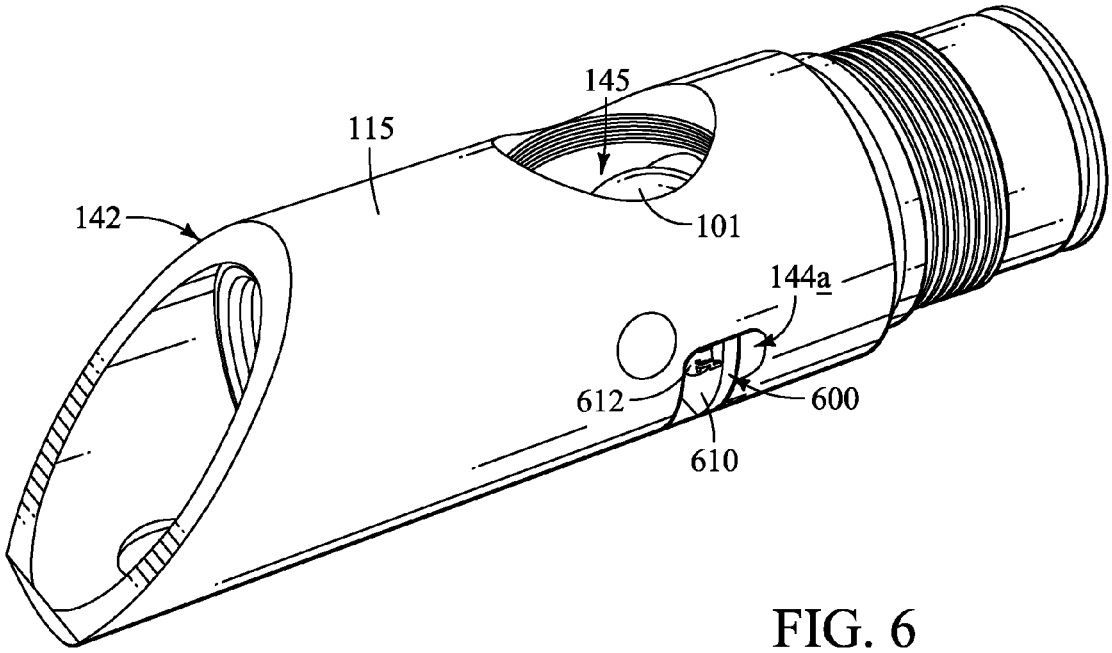
FIGS. 6, 7, and 8 are a somewhat schematic perspective, cross-sectional side, and bottom plan view respectively, illustrating a paintball detection system arrangement in a breech section of a paintball gun according to yet another embodiment of the present invention.
Figure 7:
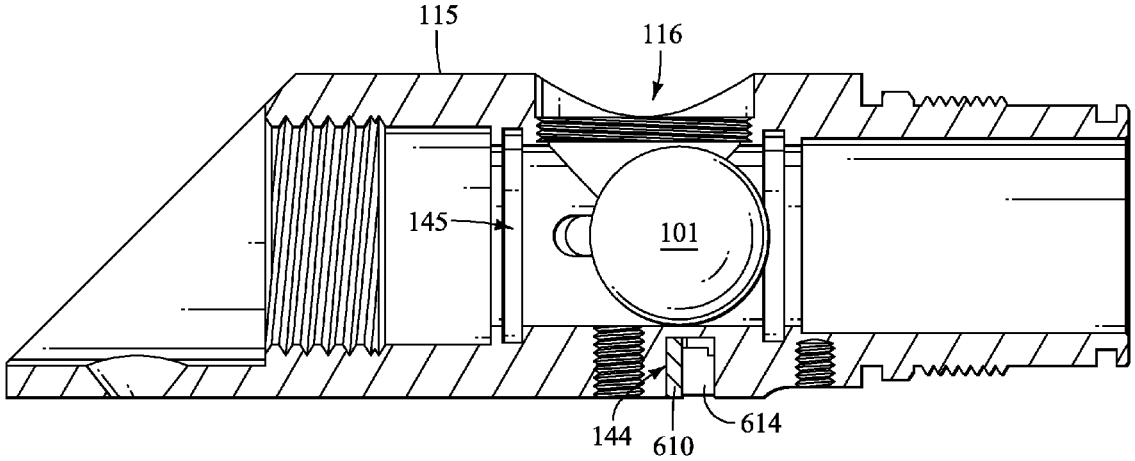
Figure 8:
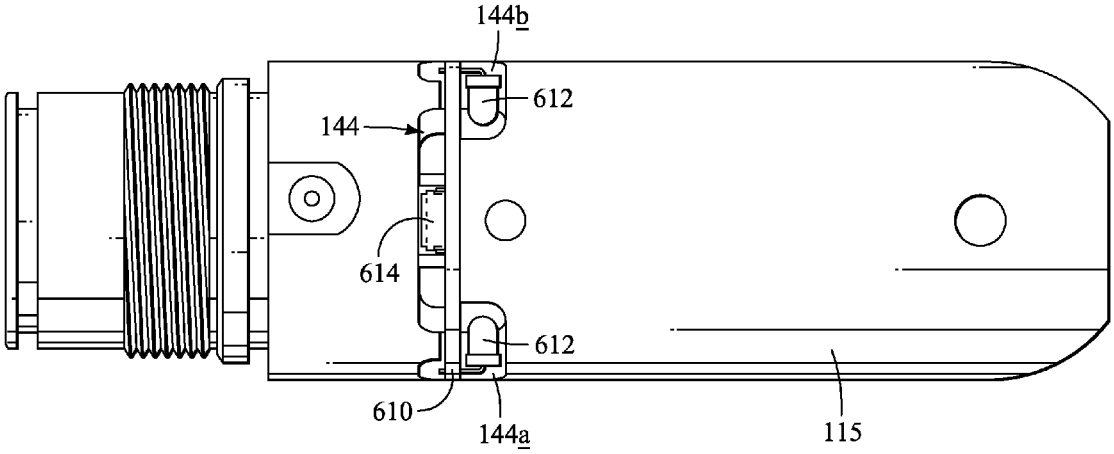

Further aspects of the present invention are illustrated in FIGS. 6, 7, and 8. Referring to FIGS. 6-9, a paintball detection system 600 can be arranged in communication with a breech area 145 of the paintball gun 100 (see FIG. 1). Most preferably, the paintball detection system 600 contains a break-beam sensor arrangement on a circuit board 610. A breech portion 142 of the pneumatic housing 115 of the paintball gun 100 is preferably provided with a recess or a cutout area 144 to receive the circuit board and opposing cutout regions 144*a*, 144*b* located on opposite sides of the breech area 145 that are configured to receive the break-beam sensors 612.

A preferred circuit board 610 and sensor 612 arrangement for the paintball detection system 600 of FIGS. 6, 7, and 8 is shown in FIG. 9. Referring to FIG. 9, the circuit board 610 preferably comprises the circuitry for controlling the break-beam or other sensors 612 and an electronic communications port 614 for communicating with a circuit board 150 of the paintball gun 100 (see FIG. 1) through wiring or wirelessly. The sensors 612 can be mounted directly to the circuit board 610, as illustrated, or can be connected remotely via wires or wirelessly. In a preferred embodiment, the circuit board 610 is configured having a "C" shape with sensors 612 arranged on opposite arms of the circuit board 610. The circuit board 610 is preferably configured to fit within a recess or cutout 144 in the pneumatic housing and locate the sensors 612 within sensor cutout regions 144*a*, 144*b* in the pneumatic housing 115 on opposite sides of the breech area 145. In the preferred break-beam sensor embodiment, the sensors 612 are preferably configured such that one transmits a beam (or other optical or radio signal) to the other sensor 612 until that signal is interrupted by the presence of a paintball 101 in the breech area 145.

Operation of the paintball detection system 600 according to the foregoing embodiment will now be described in further detail with reference to FIGS. 1 and 6-9. Referring to FIGS. 6-9, with the bolt 222 arranged in a rearward position, a paintball 101 is preferably permitted to drop from the feed tube 140 into the breech area 145 of the paintball gun 100 through the feed tube opening 116. As the paintball 101 enters the breech area 145, it breaks a beam transmitted from one of the sensors 612 to the opposing sensor 612. A signal is then preferably generated by the detection system circuit board 610 to indicate that a paintball 101 has been loaded into the paintball gun 100. Alternatively, the detection system circuit board 610 could be configured to send a signal corresponding to the absence of a paintball 101 from the breech area 145.

The detection system circuit board 610 therefore preferably communicates a signal to the paintball gun circuit board 150 to indicate either the presence or the absence of a paintball 101 in the breech area 145 of the paintball gun 100. In response to this signal, the paintball gun circuit board 150 can preferably be configured to either execute or refrain from executing a firing operation in response to a trigger pull. More specifically, if the detection system circuit board 610 indicates the absence of a paintball 101 from the breech area 145 of the paintball gun 100, the paintball gun circuit board 150 is preferably configured to refrain from executing a firing operation in response to a trigger pull. If a paintball 101 is detected in the breech area 145 of the paintball gun 100, however, the paintball gun circuit board 150 is preferably configured to execute the firing operation in response to a trigger pull.

Figure 10:
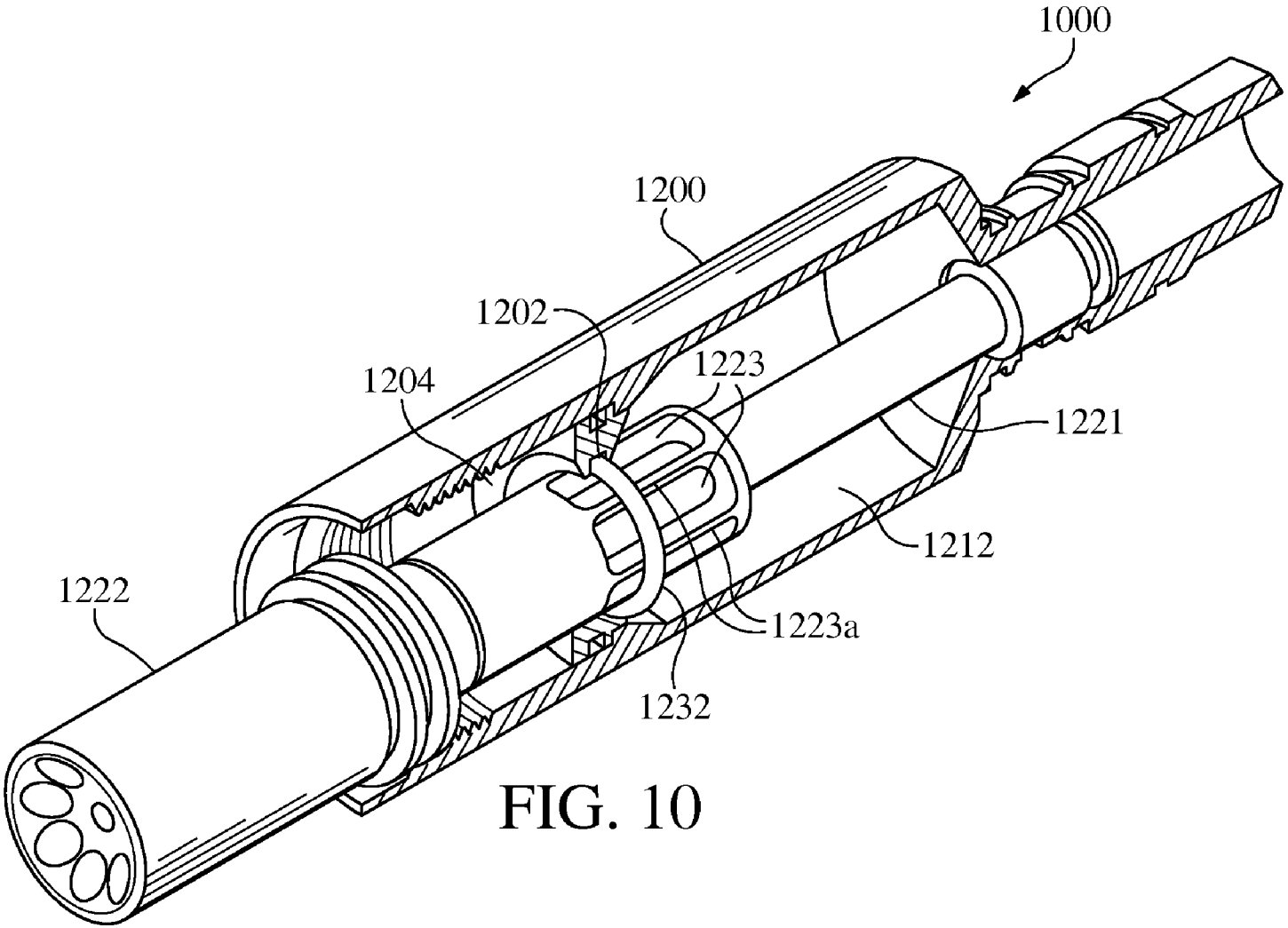
FIG. 10 is a somewhat schematic perspective cross-sectional view of a pneumatic assembly capable of use in the paintball gun of FIG. 1, according to another aspect of the present invention.

FIG. 10 is a somewhat schematic perspective cross-sectional view of a pneumatic assembly 1000 illustrating another aspect of the present invention. Referring to FIG. 10, a plurality of ribs (or fins) 1223*a* can be formed along a firing valve area 1221*a* of the bolt rod 1221 to retain an O-ring 1232 (or other sealing member) in position during a firing operation of the paintball gun (or other pneumatic launching device). As shown, an O-ring 1232 is preferably retained in an O-ring retaining groove 1202 in an O-ring retaining member 1204 to provide a sealing member for selectively preventing and permitting compressed gas to enter the bolt 1222 from a compressed gas storage area 1212. In this embodiment, when the bolt 1222 is in a rearward position, the O-ring 1232 seals around an outer surface of the firing valve area 1221*a* of the bolt rod 1221 to prevent compressed gas from escaping into the bolt 1222. When the bolt 1222 transitions to a forward position during a firing operation, however, firing grooves 1223 arranged between the ribs 1223*a* preferably permit compressed gas to escape from the compressed gas storage area 1212 into the bolt 1222 to be released from the paintball gun and launch a paintball. At the same time, however, the ribs 1223*a* prevent the O-ring 1232 from being unseated from its retaining groove 1202 and collapsing into the firing grooves 1223.

Figure 11:
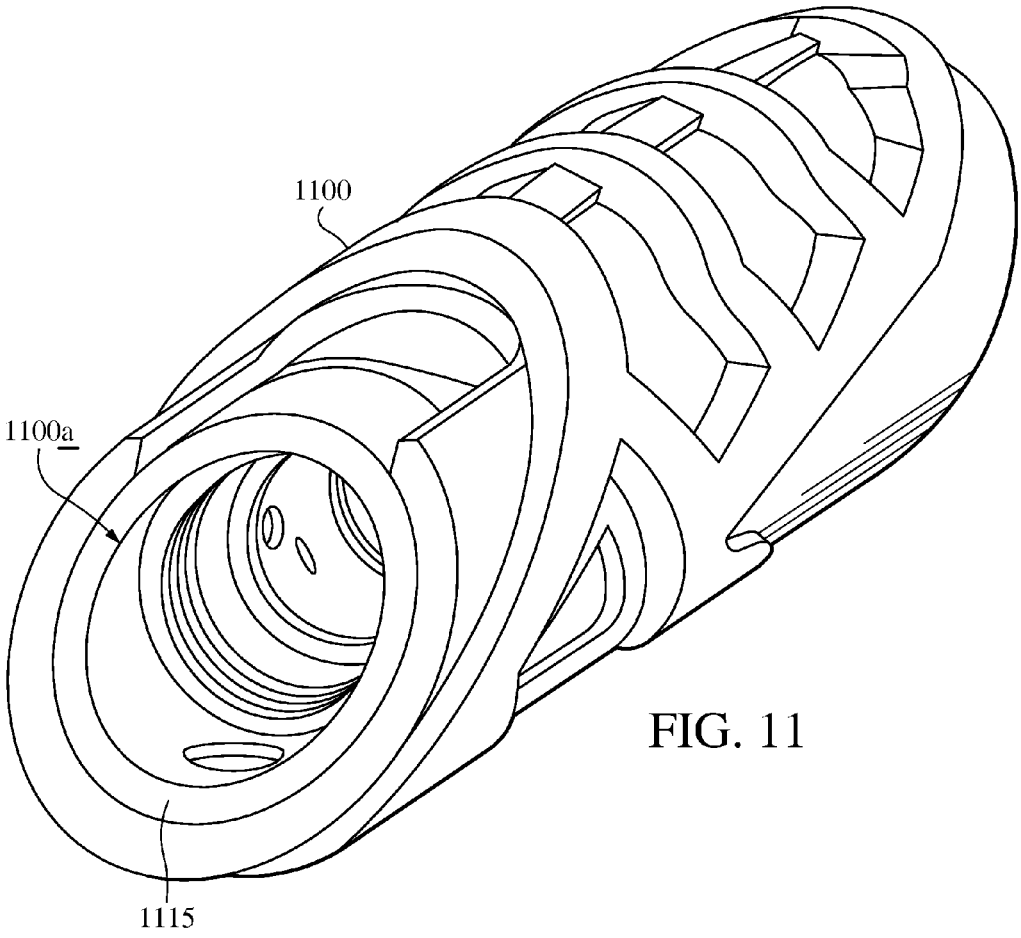
FIG. 11 is a somewhat schematic perspective view of a paintball gun body having an interchangeable external shell, according to yet another aspect of the present invention.
Figure 12:
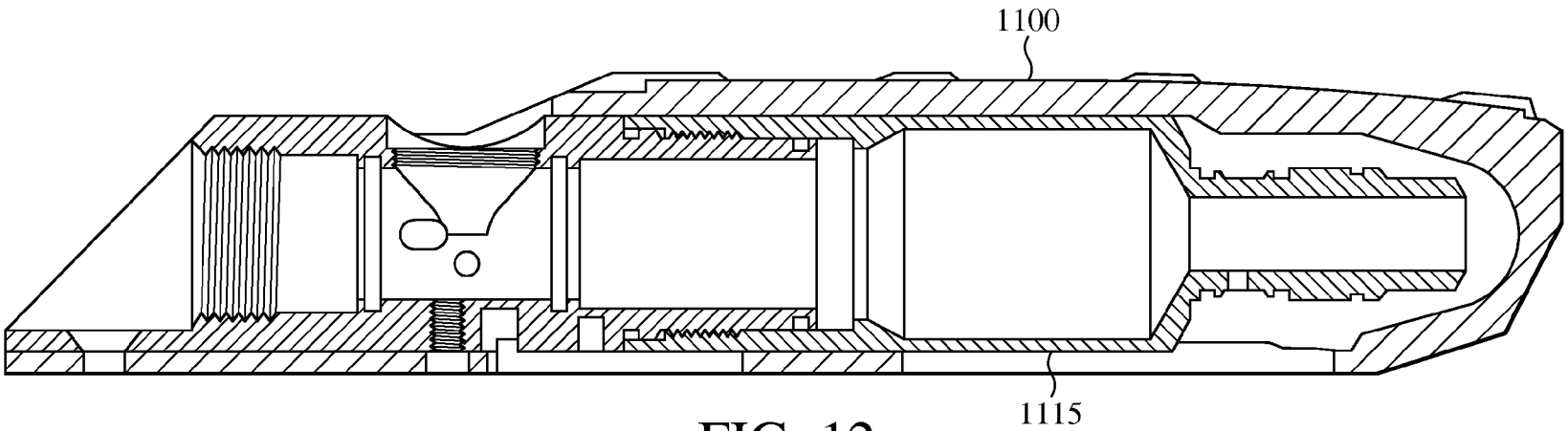
FIG. 12 is a somewhat schematic cross-sectional side view of a paintball gun body with an interchangeable external shell, as shown in FIG. 11.
Figure 13A:
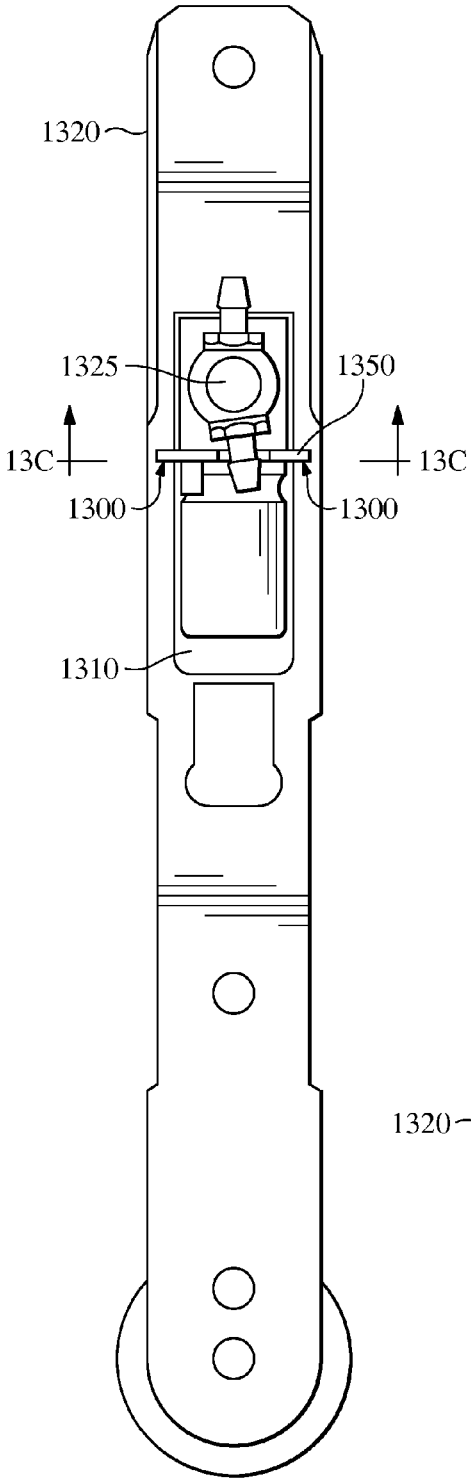
FIG. 13A is a somewhat schematic top view of a paintball gun grip frame configured to receive a grip-mounted circuit board according to a still further aspect of the present invention.
Figure 13B:
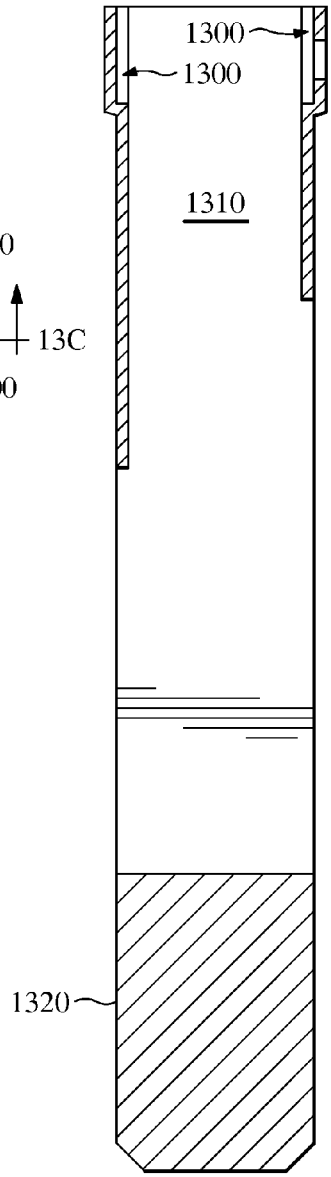
FIG. 13B is a somewhat schematic cross-sectional view of the paintball gun grip frame of FIG. 13A, illustrating a slot configured to receive a grip-mounted circuit board according.
Figure 13C:
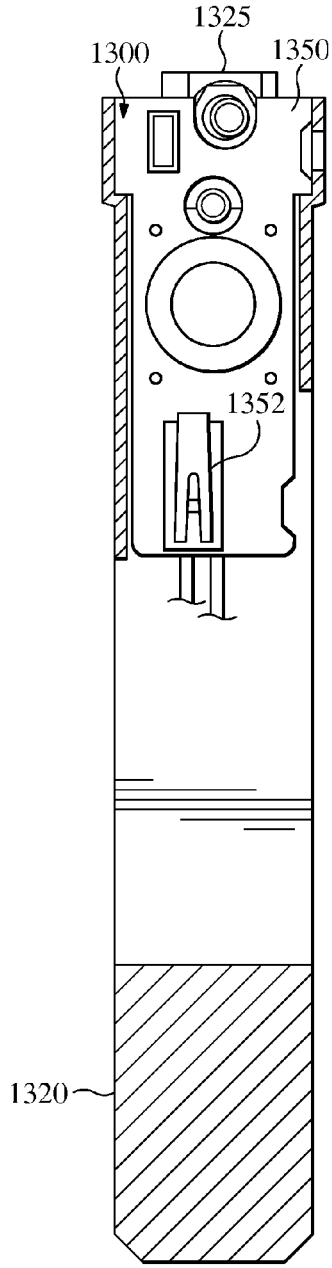
FIG. 13C is a somewhat schematic cross-sectional view of the paintball gun grip frame of FIG. 13A, illustrating a grip-mounted circuit board arranged in the slot of FIG. 13B.
Figure 14:
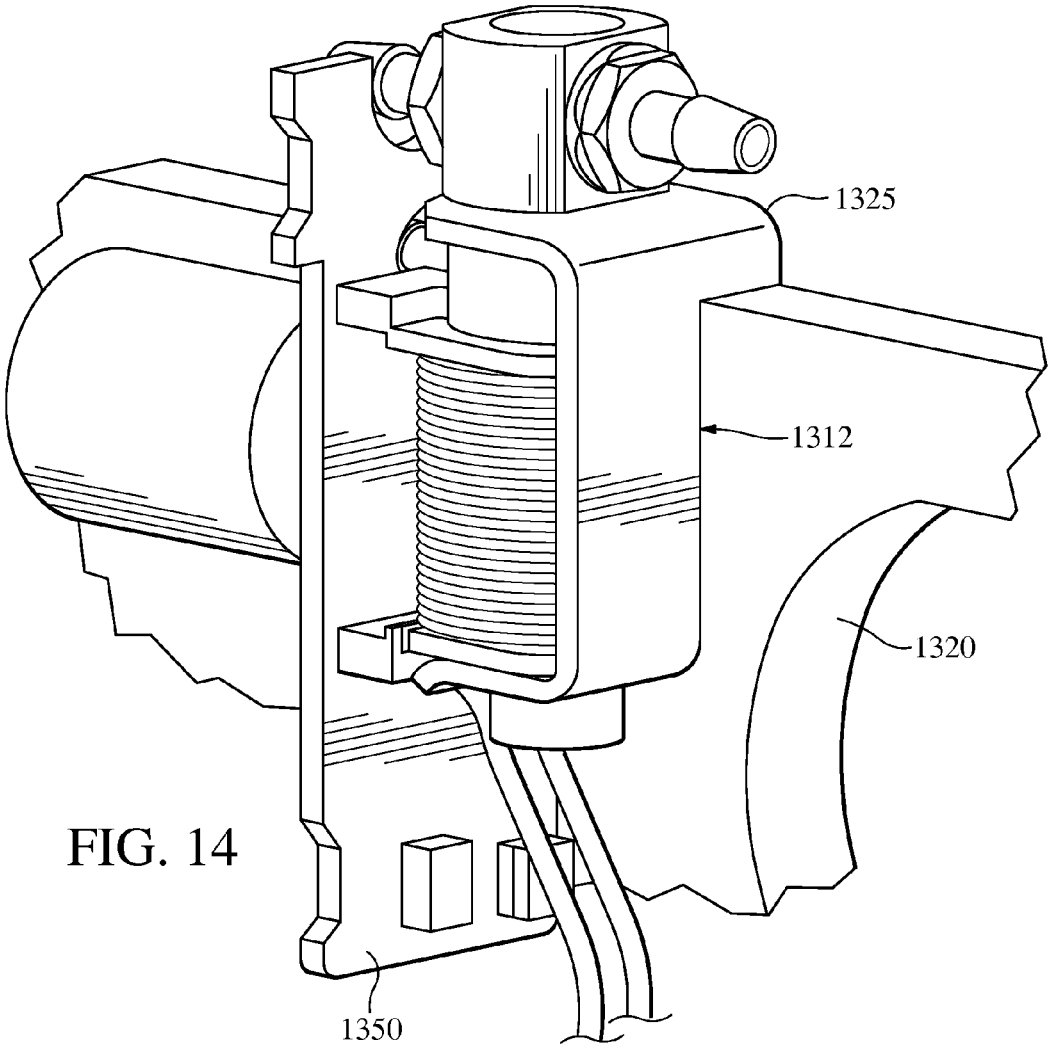
FIG. 14 is a somewhat schematic cross-sectional perspective view of a paintball gun having a grip-mounted circuit board with a solenoid valve arranged thereon.
Figure 15:
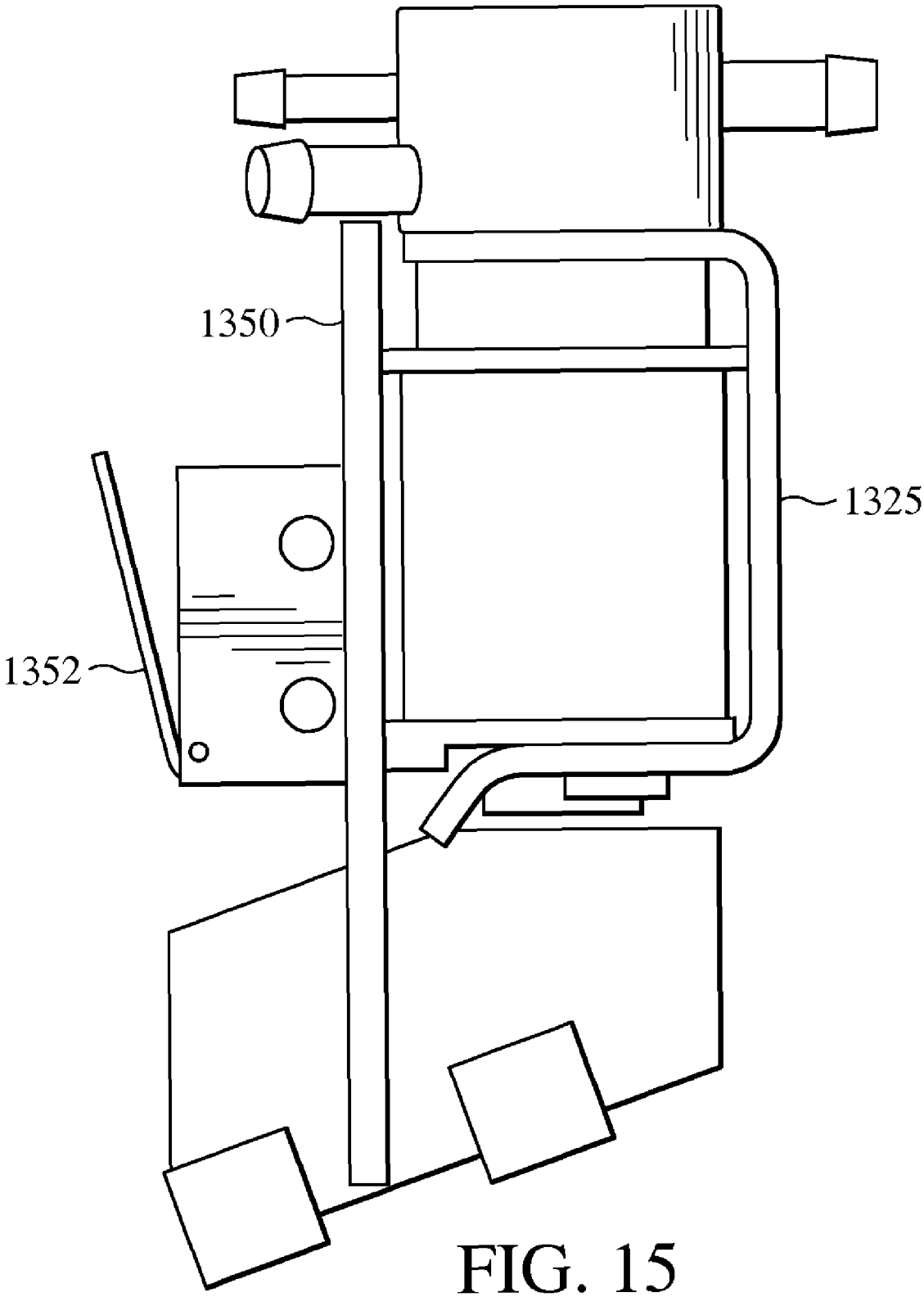
FIG. 15 is a somewhat schematic side view of a circuit board for a paintball gun having a solenoid valve and trigger-actuated microswitch arranged thereon in accordance with yet another aspect of the present invention.

FIGS. 11-12 illustrate another aspect of the present invention. Referring to FIGS. 11-12, according to a further aspect of this invention, an interchangeable shell 1100 can form the outer portion of the paintball gun body surrounding the pneumatic components 1115. The interchangeable shell 1100 can, for instance, be a plastic, metal, or composite material, but is colors, and body styles to permit a user to customize their gun to a desired appearance. The shell 1100 can be mounted to the grip frame, for instance, through one or more screws or other mounting device. The pneumatic components 1115 can be configured to slide into the external shell 1100 through a forward opening 1100*a* thereof.

FIGS. 13A-15 illustrate yet another aspect of the present invention. Referring to FIGS. 13A-15, according to a still further aspect of this invention, an improved apparatus and method for grip mounting a circuit board 1350 can be provided. According to this method, one or more slots 1300 are preferably arranged in the grip frame to receive the circuit board. Most preferably, one slot 1300 is arranged on each side of an opening 1310 on the inside of the grip frame 1320 to receive opposing sides of the circuit board 1350. The depth of the slots 1300 is preferably selected to arrange the circuit board 1350 in the appropriate location when the circuit board 1350 is fully inserted into the slots 1300. The circuit board 1350 and slot 1300 may further have a mating step-like configuration. In this embodiment, no tools or mounting screws are required to secure the circuit board 1350 in the paintball gun, thereby reducing the cost of parts and the cost of manufacturing. Manufacturing consistency is also improved.

A solenoid valve 1325 is preferably mounted on the circuit board 1350 and arranged in the grip 1320 of the paintball gun. A slot 1312 in the grip is preferably sized to securely receive both the circuit board 1350 and the solenoid valve 1325. The circuit board 1350 can further include a trigger-actuated microswitch 1352 arranged on the circuit board 1350, preferably on an opposite side of the circuit board 1350 from the solenoid valve 1325.

Figure 16:
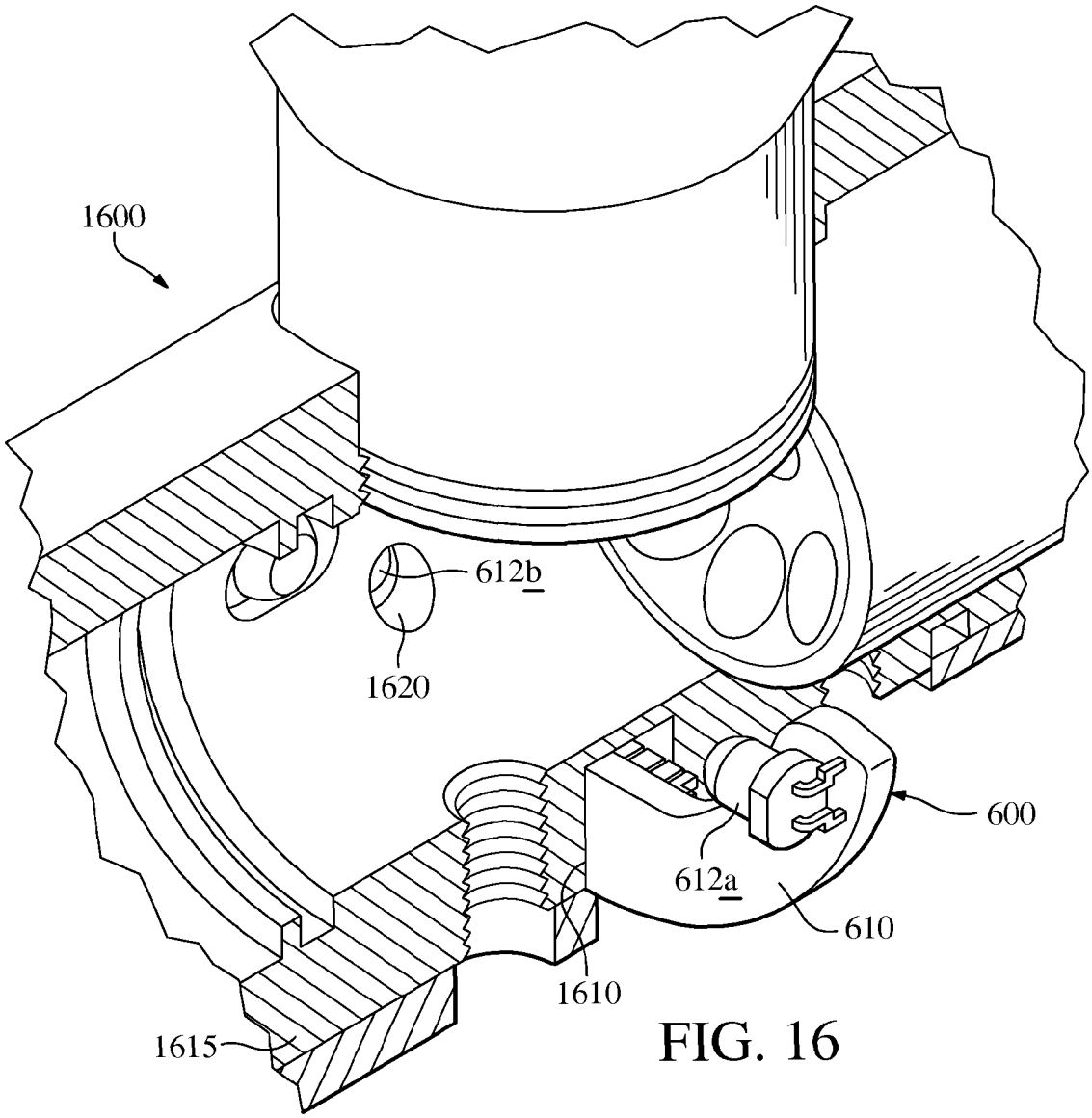
FIG. 16 is a somewhat schematic cross-sectional perspective view of a paintball gun having the paintball detection system of FIGS. 6-9, illustrating a method of mounting the paintball detection system according to another aspect of the present invention.

FIG. 16 is a cross-sectional perspective view of a section of a paintball gun 1600 illustrating a method of mounting a paintball detection system 600 according to another aspect of the present invention. A method of mounting a paintball detection system 600 is provided. According to this method, a mounting slot 1610 is preferably arranged in a bottom portion of a pneumatic housing 1615 near a breech area of a paintball gun 1600. Holes or slots 1610 are preferably arranged through one or more sidewalls of the pneumatic housing 1615 at the breech area. A paintball detection system circuit board 610 is preferably mounted within the slot 1610 such that a sensor 612*a* disposed on the circuit board 610 can communicate with an interior of the breech area or with a sensor 612*b* arranged on an opposite side of the pneumatic housing 1615. The circuit board 610 is preferably shaped to fit within the mounting slot 1610. If a break-beam sensor system is used, holes 1620 are preferably arranged in opposing sides of the pneumatic housing 1615 in proximity to the location of the break-beam sensors once installed in the pneumatic housing 1615.

Figure 17:
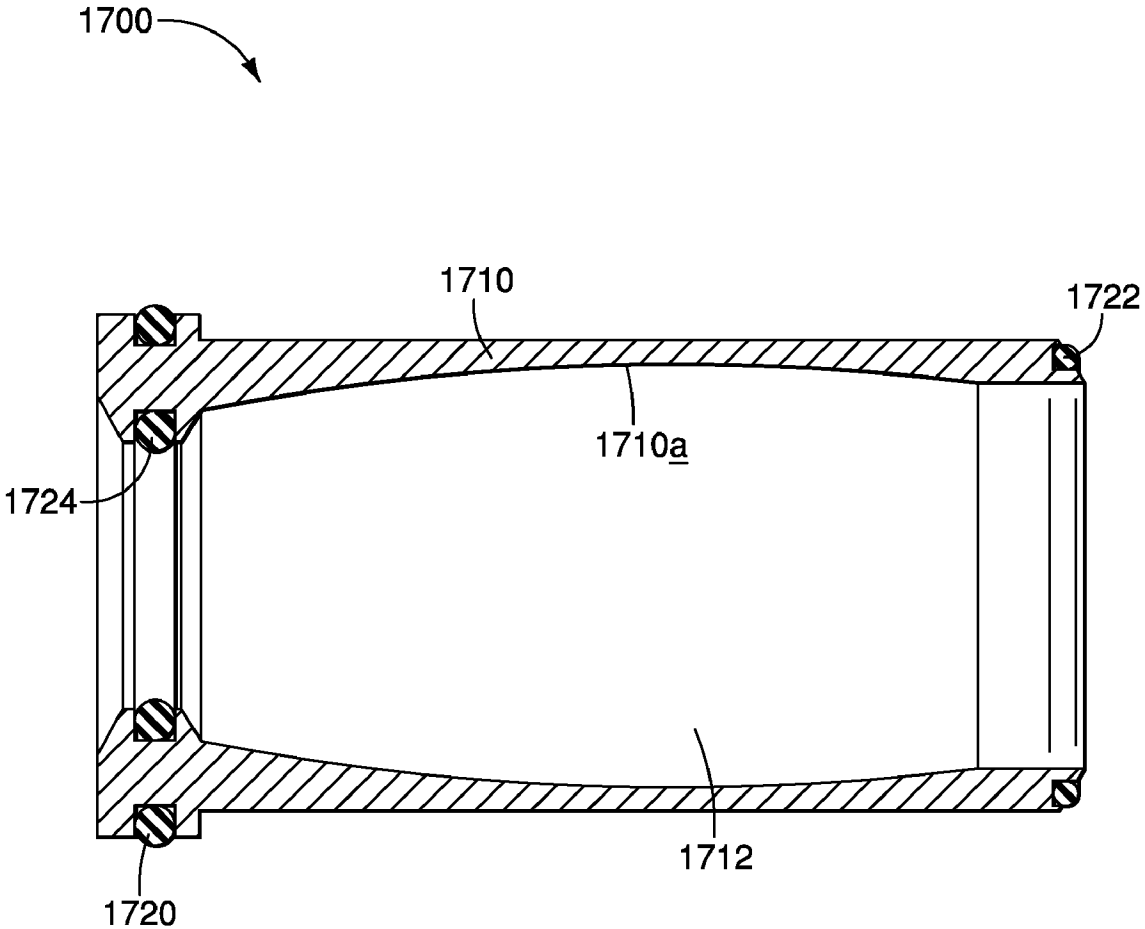
FIG. 17 is a somewhat schematic cross sectional side view of a volume restrictor for use in a compressed gas storage area of a paintball gun according to yet another embodiment of principles of the present invention.
Figure 18:
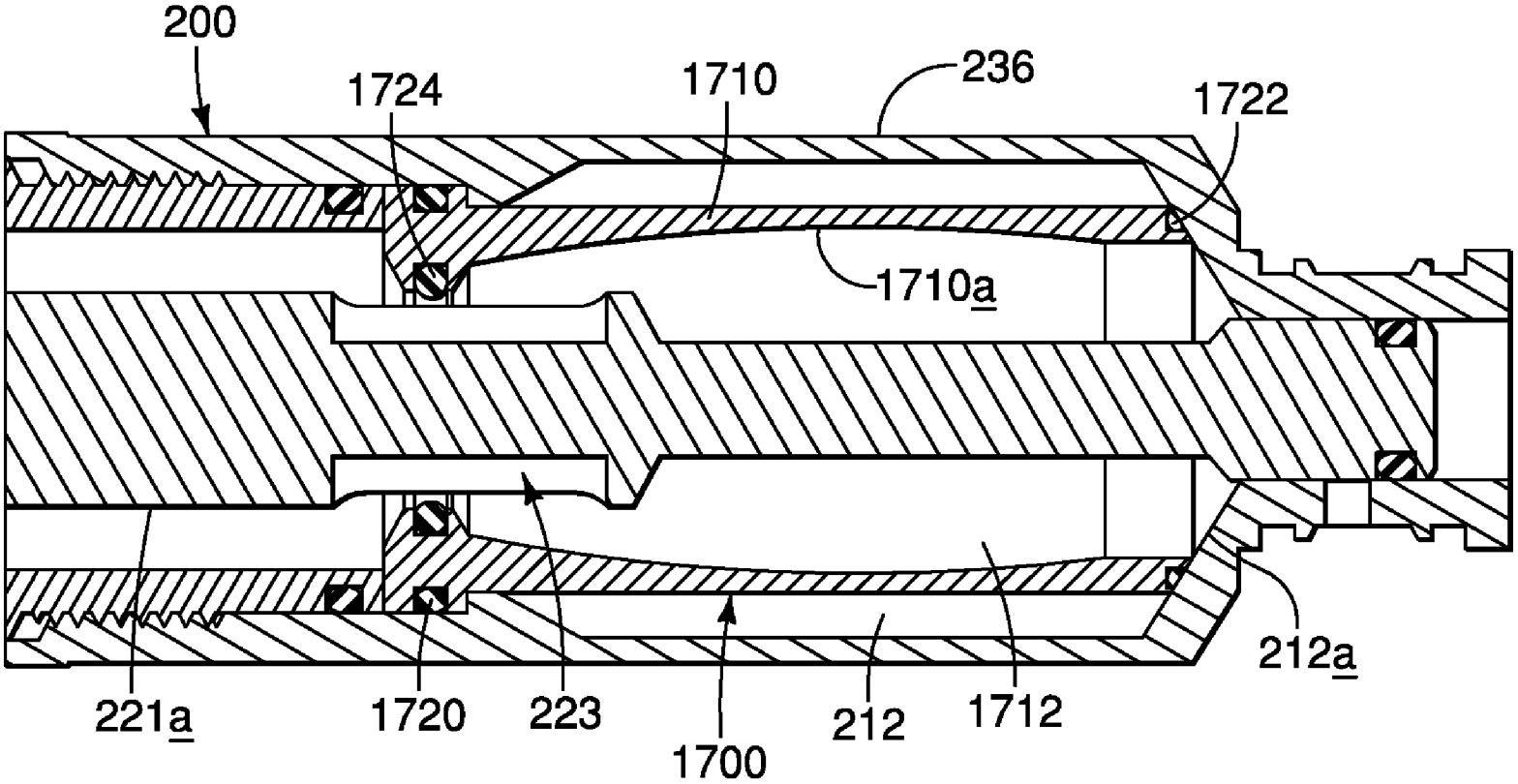
FIG. 18 is a somewhat schematic cross-sectional side view of a paintball gun pneumatic assembly having the volume restrictor of FIG. 17 arranged in a compressed gas storage area thereof according to yet another aspect of the present invention.

FIG. 17 is a somewhat schematic cross-sectional side view of a volume restrictor 1700 for reducing the effective volume of a compressed gas storage area of a paintball gun according to one configuration thereof FIG. 18 is a somewhat schematic cross-sectional side view of the volume restrictor 1700 arranged in a compressed gas storage area 212 of a pneumatic assembly 200 of a paintball gun 100 (see FIG. 1) according to yet another aspect of the present invention.

Referring to FIGS. 17 and 18, a volume restrictor 1700 preferably includes a body 1710. In a preferred configuration, the body 1710 can, for instance, be substantially cylindrical and be sized to fit within and extend through the compressed gas storage chamber 212. The volume restrictor 1700 can also include a sealing member 1724 and supporting structure to replace the sealing member 232 that cooperates with the bolt 221 to provide the firing mechanism of the pneumatic assembly 200. An external sealing ring 1720 can also be supplied to mate with an internal sidewall of the pneumatic assembly 200 in a sealing relationship. The volume restrictor 1700 can further include another sealing member 1722 arranged on an opposite end thereof to contact a rearward endwall 212*a* of the compressed gas storage chamber 212 in a sealing relationship. The internal surface 1710*a* of the volume restrictor body 1710 can be made in a flat, concave, convex, or any other desired configuration to provide the appropriate volume. In this manner, an internal volume 1712 of the volume restrictor body 1710 can provide a desired firing volume for the paintball gun 100.

More particularly, when the volume restrictor 1700 is arranged within the compressed gas storage area 212, the volume restrictor 1700 acts to reduce the volume of compressed gas that is available for a firing operation of the paintball gun 100. By restricting the volume of compressed gas available for the firing operation, the pressure of that gas must be increased to achieve the same paintball velocity. The higher pressure reduces the recharge time (e.g., the time for the compressed gas storage chamber 212 to refill between shots) and therefore allows higher rates of fire with less drop off (e.g., reduction in shot velocity during firing).

Using the volume restrictor 1700, the chamber pressure can, for example, be increased from between about 150-180 psi preferably up to between about 250-280 psi, with a shot velocity of around 240-300 feet per second. The volume of the compressed gas storage area provided using the volume restrictors of the preferred embodiments can, for example, be between about 0.500 and 1.000 cubic inches, and most preferably within the range of 0.627 and 0.901 cubic inches. Other volumes are also within the contemplation of this invention, however. In one specific example, the volume for achieving a velocity of approximately 295 feet per second with an input pressure of 260 psi is preferably about 0.796 cubic inches. Variously sized volume restrictors can be used to permit a user to configure the compressed gas storage area with any desired volume for various desired operating pressures and/or firing velocities.

In addition to the embodiment exemplified by FIGS. 17-18, any other structure that functions to reduce the volume of compressed gas available within the compressed gas storage area 212 for a firing operation could also be utilized and is within the contemplation of this invention. For instance, a volume restrictor could comprise a non-sealing insert piece, such as a ring or other shape that simply occupies a portion of the volume of the compressed gas storage area to reduce the available volume of compressed gas. Alternatively, or in addition, the rearward pneumatic housing 236 of the pneumatic assembly 200, which supplies the compressed gas storage area 212, could be replaced with a new pneumatic housing having a smaller compressed gas storage area 212. In any such manner, the volume of compressed gas available for a firing operation can be reduced and the operating pressure of the paintball gun can thereby be increased, resulting in the above-identified advantages.

Figure 19A:
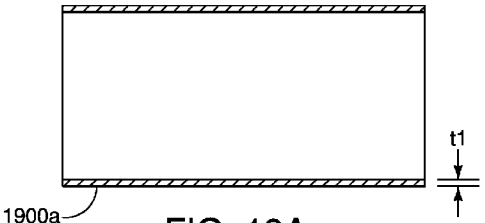
FIGS. 19A-C are somewhat schematic cross-sectional side views illustrating a plurality of volume restrictors having different sizes according to yet another embodiment of the present invention.
Figure 19B:
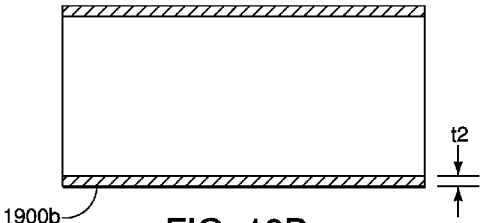
Figure 19C:
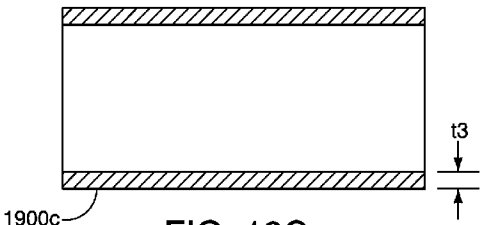
Figure 19D:
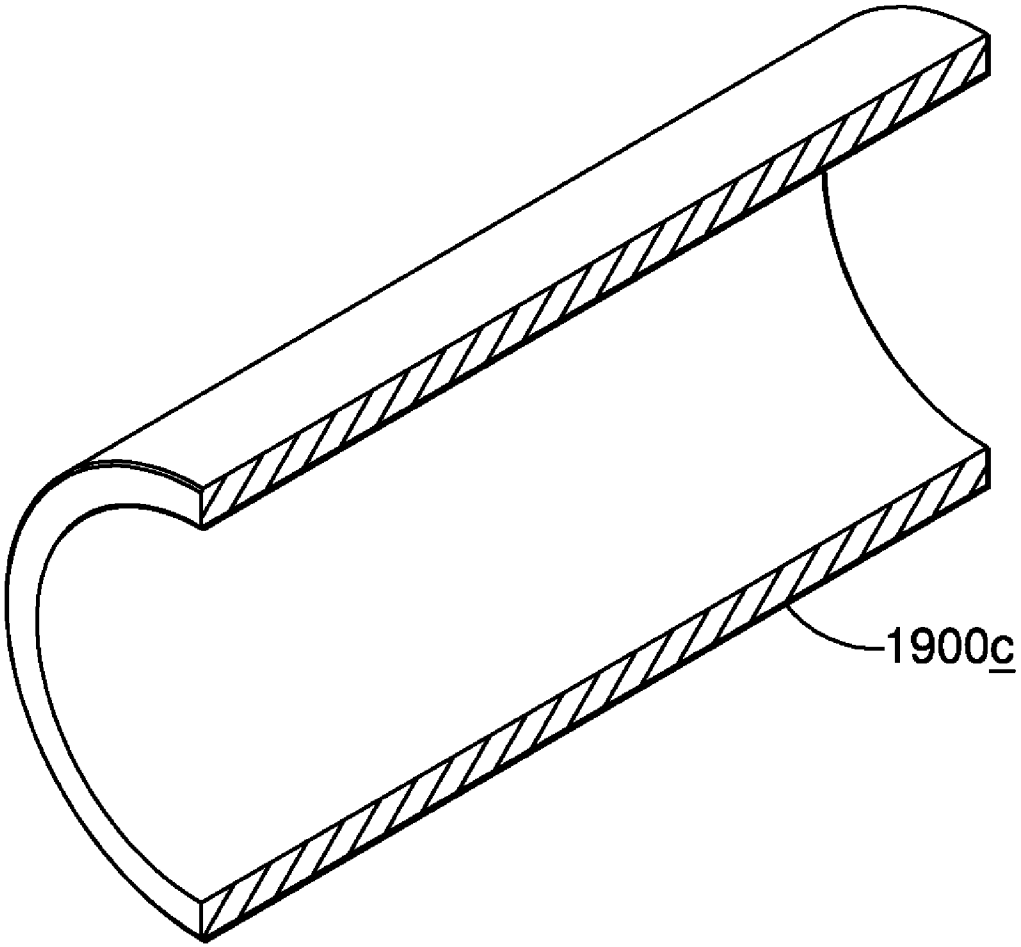
FIG. 19D is a somewhat schematic cross-sectional perspective view of the volume restrictor depicted in FIG. 19C.
Figure 20A:
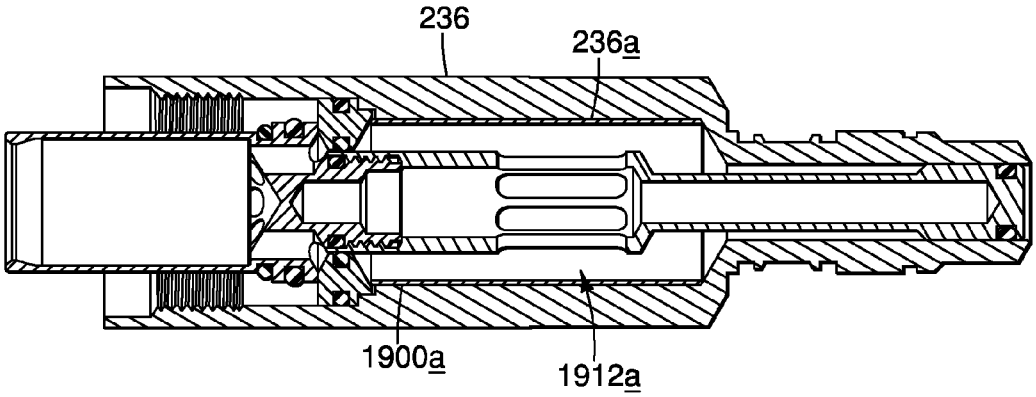
FIGS. 20A-C are somewhat schematic cross-sectional side views showing the volume restrictors of FIGS. 19A-C arranged in a pneumatic chamber of a paintball gun according to yet another aspect of the present invention.
Figure 20B:
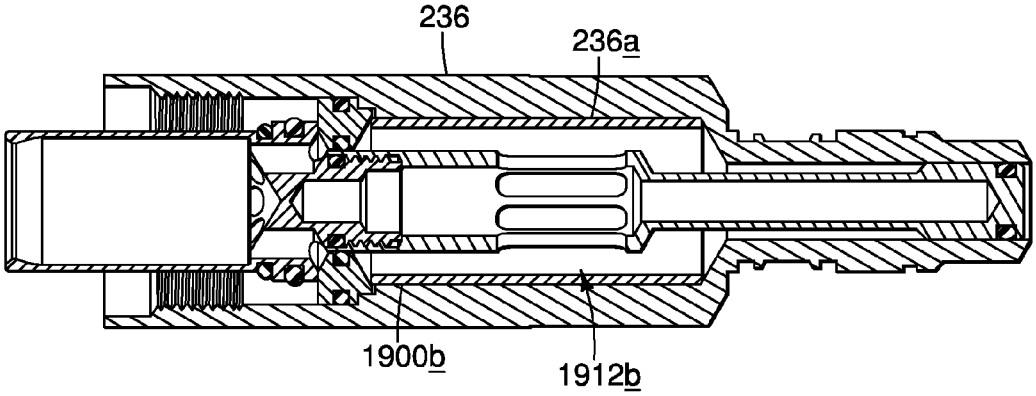
Figure 20C:
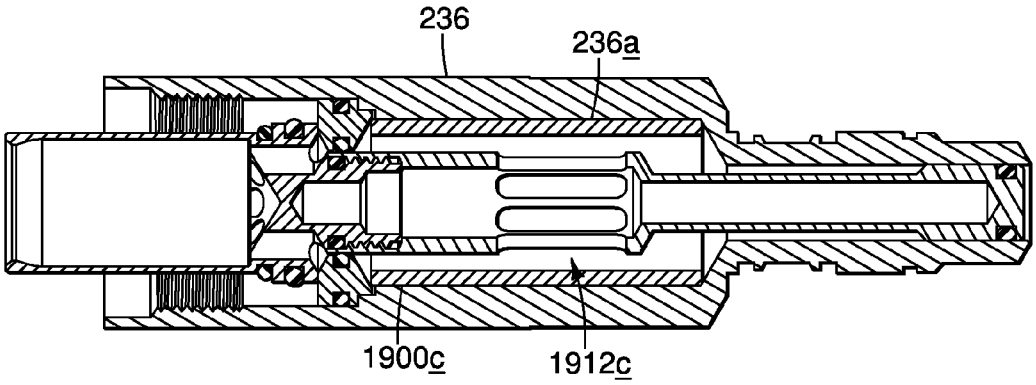

FIGS. 19A-C are somewhat schematic cross-sectional side views illustrating a plurality of volume restrictors 1900*a*, 1900*b*, 1900*c* having different sizes according to yet another embodiment of the present invention. FIG. 19D is a somewhat schematic cross-sectional perspective view of the volume restrictor 1900*c* depicted in FIG. 19C. FIGS. 20A-C are somewhat schematic cross-sectional side views showing the volume restrictors 1900*a*, 1900*b*, 1900*c* of FIGS. 19A-C arranged in a pneumatic housing 236 of a paintball gun according to yet another aspect of the present invention.

Referring to FIGS. 19A through 20C, according to yet another aspect of the present invention, variously sized volume restrictors 1900*a*, 1900*b*, 1900*c* can be provided to enable more precise selection of the appropriate chamber volume for achieving the proper paintball velocity at the desired chamber pressure. In addition, in this embodiment, the pneumatic housing 236 providing the compressed gas storage chamber 212 is preferably configured with substantially flat internal chamber walls 236*a* to provide a better fit with the volume restrictors 1900*a*, 1900*b*, 1900*c* and to provide better control over the chamber volume.

In this embodiment, the variously sized volume restrictors 1900*a*, 1900*b*, 1900*c* are each preferably cylinders or rings provided with a different wall thickness "t1", "t2", "t3" from the other volume restrictors 1900*a*, 1900*b*, 1900*c* to provide multiple different chamber volumes 1912*a*, 1912*b*, 1912*c* when arranged in the pneumatic chamber 236. A user can thereby select the appropriate volume restrictor 1900*a*, 1900*b*, 1900*c* for obtaining the desired chamber volume 1912*a*, 1912*b*, 1912*c* to achieve the proper paintball velocity at the desired operating pressure.

Having described and illustrated various principles of the present invention through descriptions of exemplary preferred embodiments thereof, it will be readily apparent to those skilled in the art that these embodiments can be modified in arrangement and detail without departing from the inventive principles made apparent herein. The claims should therefore be interpreted to cover all such variations and modifications.

What is claimed is:

1. A volume restrictor for reducing the volume of compressed gas used in a firing operation of a pneumatic paintball gun, said volume restrictor comprising:

a body configured to fit within a compressed gas storage chamber of a paintball gun; and wherein said body is configured to reduce a volume of compressed gas available within the compressed gas storage chamber for use in a firing operation of the paintball gun.

2. A volume restrictor according to claim 1, wherein the body is further configured to surround a bolt piston, where the bolt piston comprises one or more channels to communicate compressed gas from the compressed gas storage chamber to a forward end of the bolt for launching a paintball during a firing operation of the paintball gun.

3. A volume restrictor according to claim 2, further comprising a sealing member arranged to provide a selective sealing relationship with the bolt piston, wherein the sealing relationship prevents compressed gas in the compressed gas storage chamber from entering the bolt through the bolt channels when the bolt is in a first position and permits compressed gas to be released through the bolt channels when the bolt is in a second position.

4. A volume restrictor according to claim 3, wherein the sealing member is retained in a groove of the volume restrictor body.

5. A volume restrictor according to claim 4, wherein the groove is arranged in a forward end of the volume restrictor body.

6. A volume restrictor according to claim 1, wherein the body comprises an internal volume defined by an internal surface of the body and by a forward sealing member and a rearward sealing member arranged on the body, said forward and rearward sealing members configured to provide a sealing relationship with components of the paintball gun, and wherein the internal volume provides the volume of compressed gas for use in the firing operation of the paintball gun.

7. A volume restrictor according to claim 1, wherein the body is configured to occupy a portion of an internal volume of the compressed gas storage chamber to reduce the volume of gas used during a firing operation of the paintball gun.

8. A volume restrictor according to claim 7, wherein the body comprises a substantially cylindrical shape.

9. A volume restrictor according to claim 1, wherein the volume of compressed gas in the compressed gas storage chamber with the volume restrictor arranged therein is approximately between 0.620 to 0.910 cubic inches.

10. A volume restrictor according to claim 1, wherein during operation of a paintball gun comprising the volume restrictor, the pressure of compressed gas in the compressed gas storage area is between about 250 to 300 psi.

11. A volume restrictor for reducing a firing volume of compressed gas used for a firing operation of a paintball gun, the volume restrictor comprising:

a substantially cylindrical body having a forward end and a rearward end, wherein said body is configured to fit within a compressed gas storage area of a paintball gun; and wherein an internal volume of the body provides a firing volume of compressed gas used during a firing operation of the paintball gun.

12. A volume restrictor according to claim 11, further comprising a forward sealing member arranged on the forward end of the body and configured to provide a selective sealing relationship with a bolt of the paintball gun.

13. A volume restrictor according to claim 12, wherein the forward sealing member cooperates with the bolt to provide a firing mechanism of the paintball gun.

14. A volume restrictor according to claim 11, further comprising a rearward sealing member arranged on the rearward end of the body and configured to provide a sealing relationship with a rearward internal surface of the compressed gas storage area.

15. A volume restrictor according to claim 11, wherein the body comprises an internal surface, and wherein the internal surface of the body is concave.

16. A set of volume restrictors for reducing a volume of compressed gas used in a firing operation of a paintball gun, said set of volume restrictor comprising:

a first volume restrictor having a body, wherein said body fits within a compressed gas storage area of a paintball gun and reduces the volume of compressed gas within the compressed gas storage area that is available for a firing operation of the paintball gun by a first amount; and a second volume restrictor having a body, wherein said body fits within a compressed gas storage area of a paintball gun and reduces the volume of compressed gas within the compressed gas storage area that is available for a firing operation of the paintball gun by a second amount that is different than the first amount.

17. A set of volume restrictors according to claim 16, wherein the body of each of the first and second volume restrictors comprises a volume restricting ring, wherein the ring of the first volume restrictor comprises a wall having a first thickness, wherein the ring of the second volume restrictor comprises a wall having a second thickness, and wherein the first thickness is different than the second thickness.

18. A set of volume restrictors according to claim 16, further comprising a third volume restrictor.

19. A set of volume restrictors according to claim 16, wherein each said body further comprises one or more sealing members configured to seal off a portion of the compressed gas storage area such that only a portion of a previously available volume of the compressed gas storage area is available for the firing operation of the paintball gun.

20. A set of volume restrictors according to claim 19, wherein each said body further comprises a forward seal configured to seal around a bolt of the paintball gun and a rearward seal configured to seal against a rearward endwall of the compressed gas storage area.

21. A volume restrictor for reducing a volume of compressed gas used in a firing operation of a paintball gun, said volume restrictor comprising:

a means for reducing the volume of compressed gas available within a compressed gas storage area for a firing operation of a paintball gun.

22. A volume restrictor according to claim 21, wherein said means comprises a volume restricting device configured to be arranged within the compressed gas storage area, and wherein the device comprises a body having a thickness configured to reduce the volume of compressed gas that can be housed within the compressed gas storage area when the device is arranged therein.

23. A volume restrictor according to claim 22, wherein the device comprises a substantially cylindrical body.

24. A volume restrictor according to claim 21, wherein said means comprises a body configured to seal off a portion of the compressed gas storage area such that only a portion of a previously available volume of the compressed gas storage area is available for the firing operation of the paintball gun.

25. A volume restrictor according to claim 21, wherein said means comprises a replacement rearward section of a pneumatic assembly, wherein said replacement rearward section of the pneumatic assembly comprises a reduced volume compressed gas storage area.

* * * * *